US011649604B2

(12) United States Patent
Brien

(10) Patent No.: US 11,649,604 B2
(45) Date of Patent: May 16, 2023

(54) HEIGHT ADJUSTMENT MECHANISM FOR A MANHOLE ASSEMBLY AND MANHOLE ASSEMBLY COMPRISING THE SAME

(71) Applicant: Trevor Brien, Kamloops (CA)

(72) Inventor: Trevor Brien, Kamloops (CA)

( * ) Notice: Subject to any disclaimer, the term of this patent is extended or adjusted under 35 U.S.C. 154(b) by 28 days.

(21) Appl. No.: 17/324,225

(22) Filed: May 19, 2021

(65) Prior Publication Data

US 2021/0270002 A1 Sep. 2, 2021

Related U.S. Application Data

(62) Division of application No. 16/575,843, filed on Sep. 19, 2019, now Pat. No. 11,053,658.

(51) Int. Cl.
*E02D 29/14* (2006.01)

(52) U.S. Cl.
CPC ..... *E02D 29/1409* (2013.01)

(58) Field of Classification Search
CPC ..... E02D 29/1409
USPC ..... 404/25–26; 52/20–21
See application file for complete search history.

(56) References Cited

U.S. PATENT DOCUMENTS

| | | | |
|---|---|---|---|
| 638,692 | A | 12/1899 | James |
| 1,447,256 | A | 3/1923 | Lincoln |
| 2,490,075 | A | 12/1949 | Matheis |
| 4,075,796 | A | 2/1978 | Cuozzo |
| 4,174,183 | A | 11/1979 | Ferns |
| 4,255,909 | A | 3/1981 | Soderstrom |
| 4,325,405 | A | 4/1982 | Christo |
| 4,505,814 | A | 3/1985 | Marshall |
| 4,666,333 | A | 5/1987 | Armstrong |
| 4,906,128 | A | 3/1990 | Trudel |
| 5,211,504 | A | 5/1993 | Trudel |
| 5,360,131 | A | 11/1994 | Phillipps et al. |
| 5,655,564 | A | 8/1997 | Gavin |
| 5,785,409 | A | 7/1998 | Reinert |
| 5,974,741 | A | 11/1999 | Fukuhara |
| 6,036,401 | A | 3/2000 | Morina et al. |
| 6,179,518 | B1 | 1/2001 | Suatac |
| 6,371,687 | B1 | 4/2002 | Heintz et al. |
| 6,435,764 | B1 | 8/2002 | McNeely |
| 6,524,026 | B2 | 2/2003 | Sondrup |
| 6,811,350 | B2 | 11/2004 | Nadasde |
| 6,997,639 | B2 | 2/2006 | Nadasde |
| 7,744,305 | B2 | 6/2010 | Choi |

(Continued)

FOREIGN PATENT DOCUMENTS

| | | | |
|---|---|---|---|
| CA | 121662 | A | 11/1909 |
| CA | 1202511 | A | 4/1986 |

(Continued)

*Primary Examiner* — Raymond W Addie
(74) *Attorney, Agent, or Firm* — Oyen Wiggs Green & Mutala LLP; Nicholas Garner

(57) ABSTRACT

There is provided a height adjustment mechanism for a manhole assembly. The height adjustment mechanism includes an annular lower body having a bore. The height adjustment mechanism includes an annular upper body shaped to selectively fit partially within the bore of the lower body. A first of the lower body and the upper body includes a plurality of circumferentially spaced-apart recessed receptacles of varying depths. A second of the lower body and the upper body includes at least one protrusion extending outwards therefrom. The at least one protrusion is shaped to at least partially fit within respective ones of the receptacles.

20 Claims, 12 Drawing Sheets

(56) References Cited

U.S. PATENT DOCUMENTS

| | | | |
|---|---|---|---|
| 11,053,658 | B2 | 7/2021 | Brien |
| 2002/0136604 | A1 | 9/2002 | Sondrup |
| 2003/0235467 | A1 | 12/2003 | Gamson |
| 2007/0081857 | A1 | 4/2007 | Yoon |
| 2019/0145078 | A1 | 5/2019 | Koop |

FOREIGN PATENT DOCUMENTS

| | | | |
|---|---|---|---|
| CA | 1212270 | A | 10/1986 |
| CA | 1212662 | A | 10/1986 |
| CA | 1244669 | A | 11/1988 |
| CA | 1287247 | C | 8/1991 |
| CA | 2421048 | A1 | 3/2002 |
| CA | 2444350 | | 4/2004 |
| CA | 2444350 | C | 9/2006 |
| CA | 2418210 | C | 3/2011 |
| CA | 2615686 | C | 12/2011 |
| CA | 2743934 | A1 | 12/2012 |
| CA | 2715786 | C | 10/2014 |
| CA | 2941969 | A1 | 9/2015 |
| CA | 2843934 | C | 3/2016 |
| CA | 2840696 | C | 7/2016 |
| CA | 2840139 | C | 8/2016 |
| CA | 3008462 | A1 | 10/2017 |
| CA | 2671260 | C | 1/2018 |
| CA | 2894378 | C | 4/2018 |
| CA | 2991895 | A1 | 8/2018 |
| CA | 2991901 | A1 | 8/2018 |
| CA | 2892191 | C | 10/2018 |
| CA | 2970969 | A1 | 10/2018 |
| CA | 2859219 | C | 3/2019 |
| CA | 2778146 | C | 10/2019 |
| CA | 2803994 | C | 1/2020 |
| CA | 3020452 | C | 1/2020 |
| CA | 2997150 | C | 8/2020 |
| CA | 3123261 | C | 5/2022 |
| CA | 3079446 | C | 9/2022 |
| CA | 3019528 | C | 10/2022 |
| CN | 2458346 | Y | 11/2001 |
| DE | 2943918 | A1 | 5/1981 |
| FR | 2788069 | A3 | 7/2000 |
| JP | 2009007757 | A | 1/2009 |
| JP | 2009215777 | A | 9/2009 |
| KR | 20050031690 | A | 4/2005 |
| WO | 2007026976 | A1 | 3/2007 |
| WO | 2007043747 | A1 | 4/2007 |

HEIGHT ADJUSTMENT MECHANISM FOR A MANHOLE ASSEMBLY AND MANHOLE ASSEMBLY COMPRISING THE SAME

BACKGROUND OF THE INVENTION

Field of the Invention

There is provided a height adjustment mechanism. In particular, there is provided a height adjustment mechanism for a manhole assembly, and a manhole assembly comprising the same.

BRIEF SUMMARY OF INVENTION

There is provided an improved height adjustment mechanism for a manhole assembly, as well as a manhole assembly comprising the same.

According to one aspect, there is provided a height adjustment mechanism for a manhole assembly. The height assembly mechanism includes an annular lower body having a threaded interior bore. The height assembly mechanism includes an annular insert threadably engageable with the lower body. The height assembly mechanism includes an annular upper body threadably engageable with and extending outwards from the lower body. Abutting of the upper body with the insert fixes positioning of the upper body.

According to a further aspect, there is provided a height adjustment mechanism for a manhole assembly. The height assembly mechanism includes an annular lower body having a bore and an axis. The lower body includes two or more radially inwardly-extending, axially-spaced-apart height-fixing supports. The height assembly mechanism includes an annular upper body with an annular wall. The upper body has an aperture extending through the wall thereof. The upper body includes at least one protuberance coupled to and extending radially outwards from the wall thereof. The aperture is adjacent to the protuberance. The upper body is axially rotatable from an insertion position in which the upper body is in part insertable within the bore of the lower body, to a fixed position in which the protuberance is abutable with a respective one of the height-fixing supports. The height assembly mechanism includes a locking member selectively insertable via the aperture of the wall. The locking member is configured to inhibit rotation of the upper body relative to the lower body.

According to another aspect, there is provided a height adjustment mechanism for a manhole assembly. The height assembly mechanism includes an annular lower body having a bore and an axis. The height assembly mechanism includes two or more radially inwardly-extending, axially-spaced-apart height-fixing supports. The height assembly mechanism includes an annular upper body. The upper body includes at least one protuberance extending radially outwards therefrom. The protuberance has a groove axially-extending therethrough. The upper body is axially rotatable from an insertion position in which the upper body is insertable in part within the bore of the lower body to a fixed position in which the protuberance is abutable with a respective one of the height-fixing supports. The height assembly mechanism includes a locking member insertable within the groove of the protuberance. The locking member is abutable with at least one distal end of at least one of the height-fixing supports. The locking member is configured to inhibit rotation of the upper body relative to the lower body.

According to yet a further aspect, there is provided a height adjustment mechanism for a manhole assembly. The height assembly mechanism includes an annular lower body having a bore and an axis. The lower body includes two or more radially inwardly-extending, axially-spaced-apart height-fixing supports. Each of the height-fixing supports has spaced-apart tapered ends. The height assembly mechanism includes an annular upper body. The upper body includes at least one radially outwardly-extending protuberance. The protuberance has spaced-apart tapered ends. The upper body is axially rotatable from an insertion position in which the upper body is insertable in part within the bore of the lower body to a fixed position in which the protuberance is abutable with a respective one of the height-fixing supports.

According to yet another aspect, there is provided a height adjustment mechanism for a manhole assembly. The height assembly mechanism includes an annular lower body having a lower end, an upper end spaced-apart from the lower end, an axis and a bore. The axis and the bore extend from the lower end to the upper end of the lower body. The lower body includes a plurality of axially spaced-apart, height-fixing support assemblies. The height assembly mechanism includes an annular upper body having a lower end and an upper end spaced-apart from the lower end of the upper body. The upper body includes a plurality of circumferentially spaced-apart, radially outwardly-extending flange members. The flange members are adjacent to the lower end of the upper body. The upper body is axially rotatable from an insertion position in which the upper body is insertable in part within the bore of the lower body to a fixed position in which at least one of the flange members is abutable with a respective one of the height-fixing support assemblies.

According to an even further aspect, there is provided a height adjustment mechanism for a manhole assembly. The height assembly mechanism includes an annular lower body having a bore. The lower body includes an annular wall extending about the bore. The height assembly mechanism includes an annular upper body. The upper body includes an annular wall and is shaped to selectively fit partially within the bore of the lower body. The wall of a first of the lower body and the upper body includes a plurality of circumferentially spaced-apart recessed receptacles of varying depths. The wall of a second of the lower body and the upper body includes at least one protrusion extending radially outwards therefrom. The protrusion is shaped to at least partially fit within respective ones of the receptacles.

There is also provided a manhole assembly including any one of the above set out the height adjustment mechanisms.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 3:
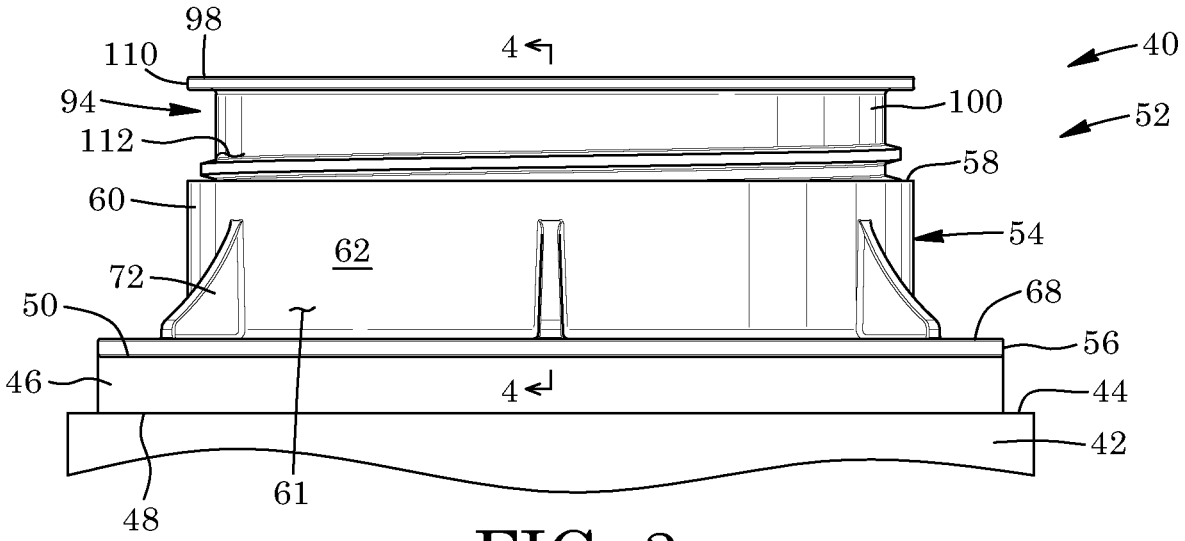
FIG. 3 is a side elevation of the assembly of FIG. 2, with the insert disposed within and threadably coupled to the lower body, with the upper body threadably engaged with the lower body and being shown in an intermediate height position, and a spacer ring of the assembly further being shown and a manhole barrel of the assembly also being shown in fragment.

Referring to the drawings and first to FIG. 3, there is shown a manhole assembly 40.

The manhole assembly includes a manhole barrel 42 partially shown in fragment. The manhole barrel has a top 44. The manhole assembly 40 includes an annular spacer, in this example a concrete spacer ring 46. The spacer ring has a bottom 48 which abuts the top 44 of the manhole barrel 42. The spacer ring has a top 50 spaced-apart from the bottom thereof. Manhole barrels and spacer rings per se, including their various parts and functionings, are well known to those skilled in the art and thus will not be described in further detail.

Figure 1:
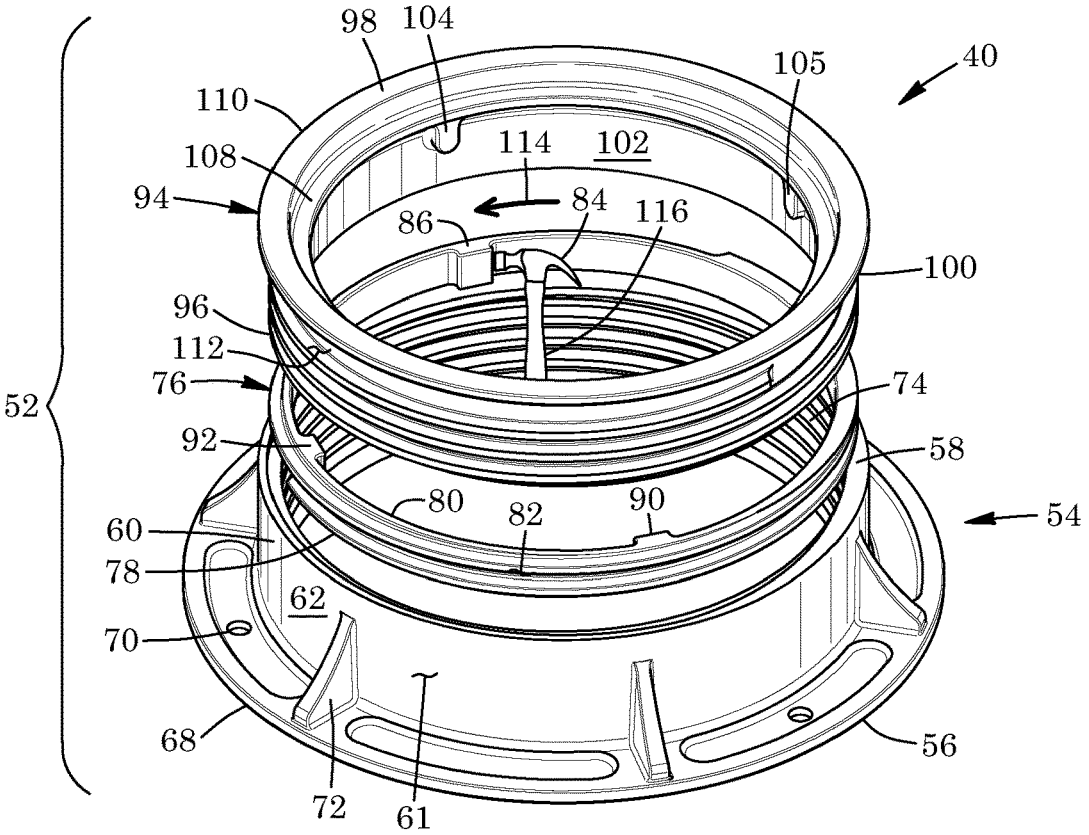
FIG. 1 is a top, front, exploded perspective view of a manhole assembly according to a first aspect, the assembly including an annular lower body, an annular upper body and an annular insert therebetween.
Figure 2:
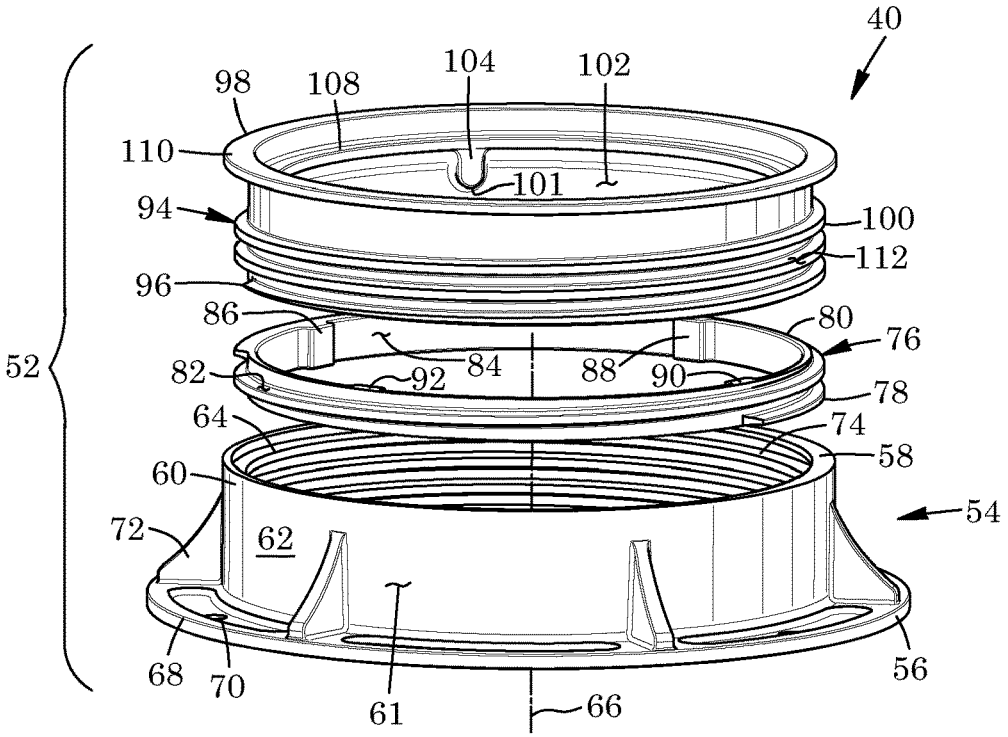
FIG. 2 is a front, exploded perspective view thereof.

As seen in FIG. 1, the manhole assembly 40 includes a height adjustment mechanism 52. The height adjustment mechanism includes an annular lower body 54. The lower body has a lower end 56 and an upper end 58 spaced-apart from the lower end. As seen in FIG. 2, the lower body 54 has an annular wall 60 which extends from the lower end to the upper end thereof. The wall has an exterior surface 61 and the lower body has an exterior 62 aligned with the exterior surface. The lower body 54 has an interior surface, in this example a threaded interior surface 64. The lower body has a longitudinal, central axis 66 about which the wall 60 extends.

As seen in FIG. 3, lower body 54 has an annular flange 68 coupled to and extending radially outwards from wall 60 at the lower end 56 of the lower body. The flange abuts and extends along the top 50 of spacer ring 46. As seen in FIG. 1, a plurality of circumferentially spaced-apart apertures 70 extend through the flange 68. The apertures are shaped to receive fasteners, in this example bolts (not shown) for coupling the flange to the spacer ring 46 seen in FIG. 3. Referring back to FIG. 1, the lower body 54 includes a plurality of circumferentially spaced-apart stiffener members, in this example triangular stiffener plates 72 which extend between and couple together the flange 68 and wall 60.

As seen in FIG. 2, lower body 54 has a bore 74 about which annular wall 60 extends. The threaded interior surface 64 of the lower body and the bore are in communication with each other. The threaded interior surface 64 extends from the lower end 56 to the upper end 58 of the lower body 54.

Figure 4:
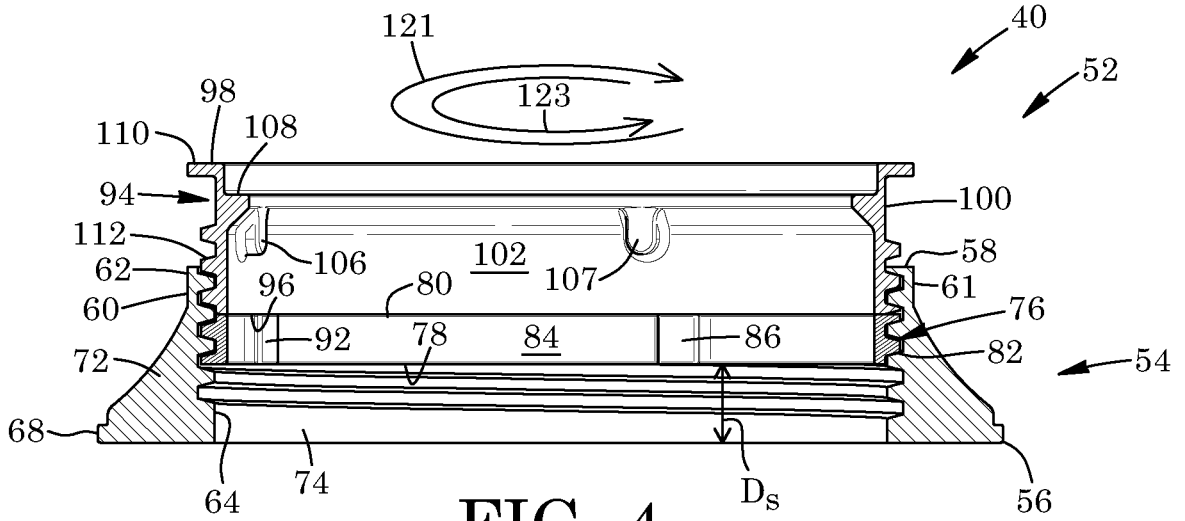
FIG. 4 is a sectional elevation view taken along lines 4-4 of the assembly shown in FIG. 3.

Referring to FIG. 1, the height adjustment mechanism 52 includes an annular insert, in this example a lock ring 76. The lock ring has a lower end 78 and an upper end 80 spaced-apart from its lower end. The lock ring 76 includes a threaded exterior surface 82. As seen in FIG. 4, the lock ring is insertable within the lower body 54 via bore 74 and the threaded exterior surface of the lock ring is configured to threadably engage with the threaded interior surface 64 of the lower body.

As seen in FIG. 2, the lock ring 76 includes an interior wall 84 opposite the threaded exterior surface 82 thereof. The lock ring includes a plurality of circumferentially spaced-apart, radially inwardly-extending protrusions, in this example four evenly spaced-apart protrusions 86, 88, 90 and 92. The protrusions are generally rectangular prisms in shape in this example and extend from the lower end 78 to the upper end 80 of the lock ring 76 in this example.

Referring to FIG. 1, the height adjustment mechanism 52 includes an annular upper body 94. The upper body has a lower end 96 and an upper end 98 spaced-apart from the lower end. As seen in FIG. 4, the lower end of the upper body is shaped to abut the upper end 80 of the lock ring 76.

Referring back to FIG. 1, the upper body 94 has an annular wall 100 extending from the lower end 96 to the upper end 98 thereof. The annular wall has a lower interior surface 102. The lower interior surface of the wall 100 extends from the lower end 96 towards the upper end 98 of the upper body 94. The upper body includes a plurality of circumferentially spaced-apart protrusions which couple to and extend radially inwards relative to the lower interior surface 102 of the wall. In this example, there are four, evenly spaced-apart protrusions, as shown by way protrusions 104 and 105 in FIG. 1 and protrusions 106 and 107 in FIG. 4. Each protrusion has a rounded bottom, in this example an outwardly convex-facing bottom, as seen by bottom 101 for protrusion 104 in FIG. 2.

Referring to FIG. 4, the upper body 94 has an annular lip 108 which extends radially inwards relative to the wall 100. The annular lip is positioned between the lower end 96 and the upper end 98 of the upper body, and is positioned above and adjacent to the protrusions as shown by protrusions 106 and 107 in this example. The annular lip 108 is shaped receive a manhole cover (not shown).

Referring back to FIG. 2, the upper body 94 includes a radially outwardly-extending flange 110 which extends radially outwards from the wall 100 of the upper body. The flange is adjacent to the upper end 98 of the upper body. As seen in FIG. 1, annular lip 108 extends radially inwards relative to the flange 110.

Still referring to FIG. 1, the wall 100 of the upper body 94 has a lower exterior surface, in this example a lower threaded exterior surface 112. As seen in FIG. 4, the upper body 94 is shaped to selectively fit partially within the bore 74 of the lower body 54 and threadably engage with interior surface 64 of the lower body 54. The exterior surface 82 of the lock ring 76 is likewise insertable within bore 74 and threadably engageable with the interior surface of the lower body. The upper body 94 thus extends outwards and upwards from the lower body 54 in part. Abutting of the upper body with the lock ring 76 fixes positioning of the upper body relative to the lower body.

Referring to FIG. 2, each of the protrusions 86, 88, 90 and 92 of the lock ring 76 and protrusions 104 of the upper body 94 is shaped to receive a tangentially-directed force which promotes rotation of the lock ring and upper body, respectively. In this example and as seen in FIG. 1, the protrusions are shaped to receive impacts 114 from a hammer 116, with the impacts promoting rotation of the lock ring 76 and the upper body 94 relative to the lower body 54. In this manner and referring to FIG. 4, positioning of the lock ring relative to the lower body may first be adjusted to a desired height or distance of separation Ds relative to the lower end 56 of the lower body by rotating the lock ring relative to the lower body 54. Rotation of the lock ring 76 in a first direction, in this example a clockwise direction as shown by arrow of numeral 121, causes the lock ring to lower downwards relative to the lower body and from the perspective of FIG. 4. Rotation of the lock ring in a second direction, in this example a counter-clockwise direction as shown by arrow of numeral 123, causes the lock ring to raise upwards relative to the lower body 54 and from the perspective of FIG. 4.

Upon the desired height or distance of separation Ds being met, the upper body 94 is threadably positioned in place by rotating the upper body 94 in the clockwise direction relative to the lower body such that the lower end 96 of the upper body abuts with the upper end 80 of the lock ring 76 to fix positioning of the upper body relative to the lower body 54 in place.

Figure 5:
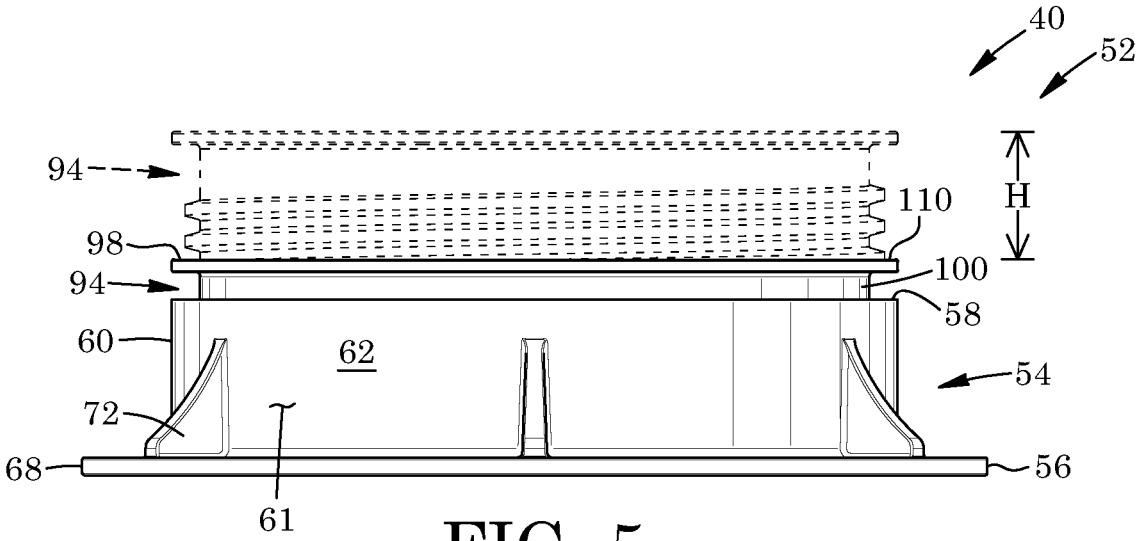
FIG. 5 is a side elevation view of the assembly of FIG. 3, with the insert disposed within and threadably coupled to the lower body, with the upper body shown in solid lines in a retracted position fully threadably engaged with the lower body, and with the upper body shown in stippled lines in an extended position and partially threadably engaged with the lower body.

As seen in FIG. 5, the manhole assembly 40 has a retracted position shown in solid lines. The lock ring 76 seen in FIG. 4 is near to the lower end 56 of the lower body 54 and the upper body 94 abuts the lock ring when the manhole assembly is in the retracted position. The manhole assembly 40 is moveable from the retracted position to an extended position shown in stippled lines in FIG. 5.

The upper body 94 abuts the lock ring 76 seen in FIG. 4. The lock ring is positioned adjacent to the upper end 58 of the lower body 54 when the manhole assembly is in the extended position. In this manner and referring to FIG. 5, the height adjustment mechanism 52 enables the height H, or extent to which the upper body 94 extends above the lower body 54, to be selectively adjustable as desired. The manhole assembly 40 may thus be installed such that flange 110 of the upper body 94 generally aligns flush with the surface of a road (not shown), for example. In this embodiment, the height H may be equal to four or five inches. However, this is not strictly required and the extent of height adjustment may be larger or small in other examples.

Height adjustment mechanism 52 may comprise a high-strength means for adjusting the extent to which the upper body 94 extends upwards from the lower body 54 that enables infinite micro-adjustment. Lock ring 76, in addition to functioning as a locking means, may further function to reduce clearance between the upper body 94 and lower body 54 which may otherwise permit rocking of the upper body relative to the lower body.

FIGS. 6 to 11 show a manhole assembly 40.1 and height adjustment mechanism 52.1 therefor according to a second aspect. Like parts have like numbers and functionings as the manhole assembly 40 and height adjustment mechanism 52 shown in FIGS. 1 to 5 with the addition of decimal extension "0.1". Manhole assembly 40.1 and height adjustment mechanism 52.1 are the same as described for manhole assembly 40 and height adjustment mechanism 52 shown in FIGS. 1 to 5 with the following exceptions.

Figure 6:
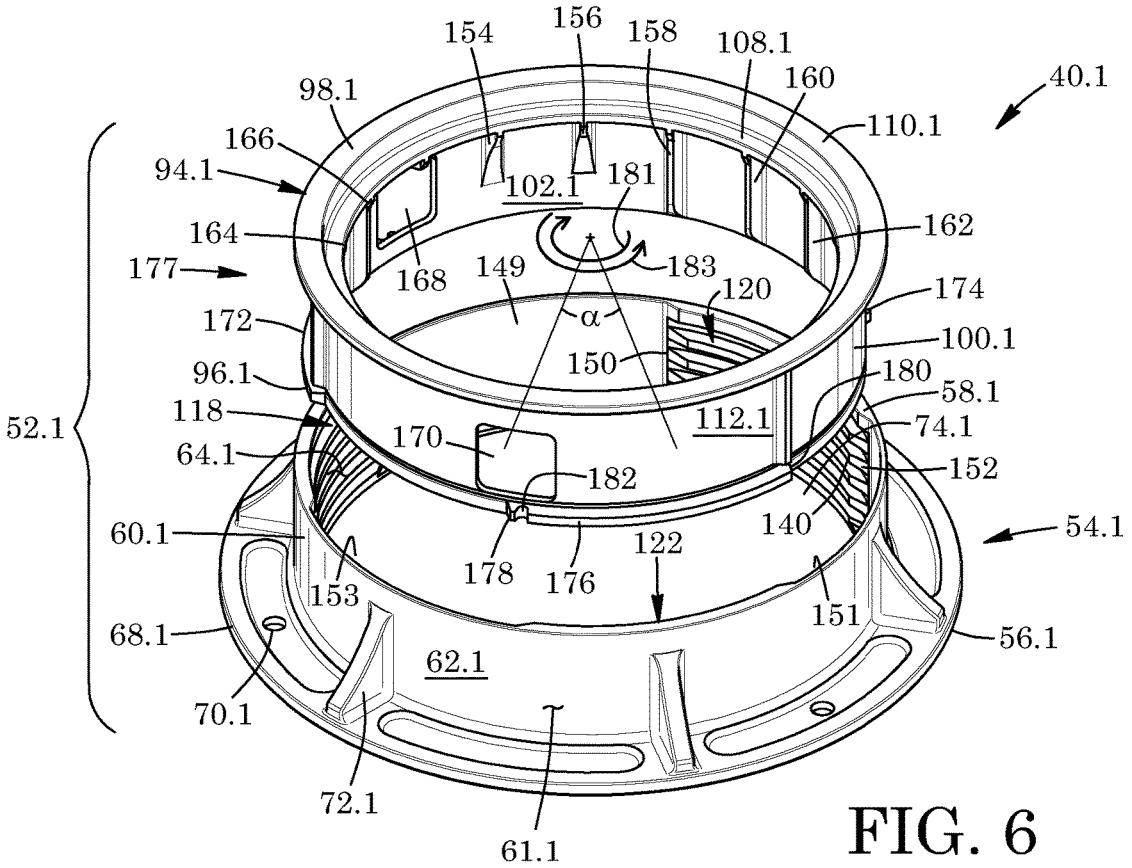
FIG. 6 is a top, front, exploded perspective view of a manhole assembly according to a second aspect, the assembly including an annular lower body comprising a plurality of circumferentially spaced-apart, axially spaced-apart and radially inwardly-extending flange members aligned in columns, and the assembly including an annular upper body with a plurality of circumferentially spaced-apart, radially outwardly-extending flange members shaped to selectively engage with the flange members of the lower body.

Referring to FIG. 6, lower body 54.1 of the manhole assembly 40.1 includes a plurality of radially inwardly-extending columns of height-fixing supports, in this example three evenly spaced-apart arrangements, in this case vertically-extending columns 118, 120 and 122, of height-fixing flange members. Each of the flange members is inwardly concave with one side aligned with interior surface 64.1 of the lower body 54.1.

Figure 7:
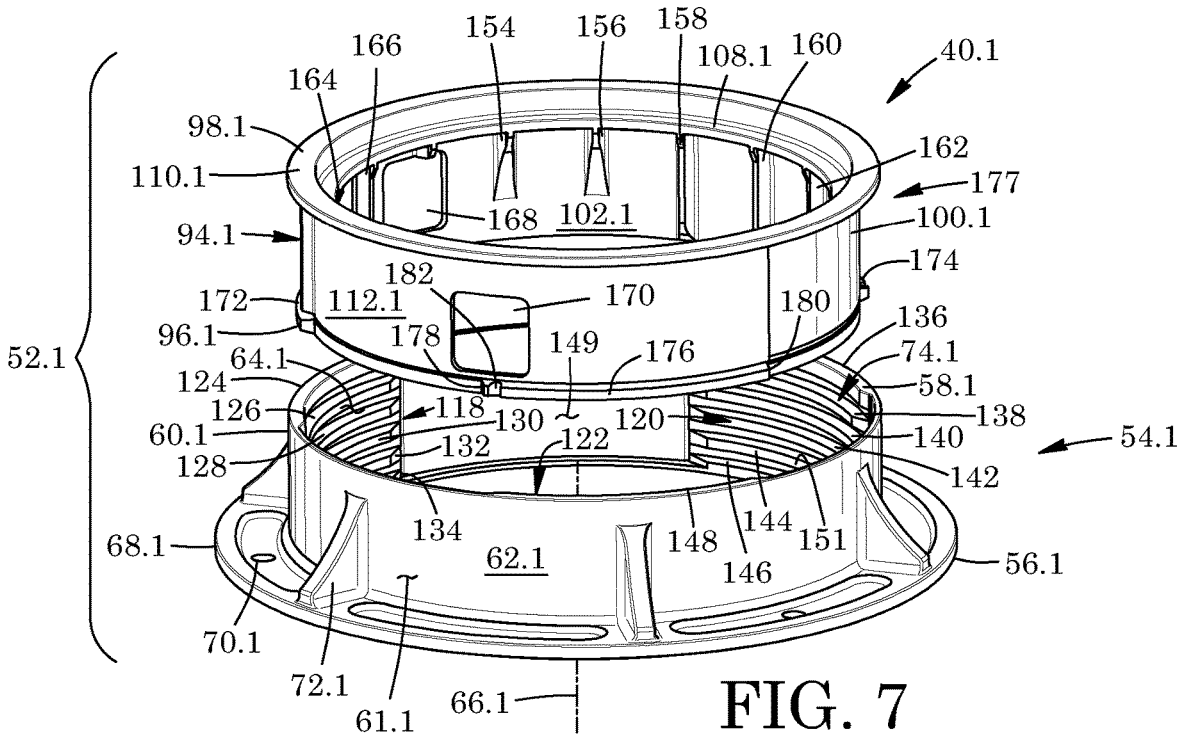
FIG. 7 is a top, front, exploded perspective view thereof.

Each column comprises a plurality of axially spaced-apart height-fixing flange members, as seen in FIG. 7 by: flange members 124, 126, 128, 130, 132 and 134 for column 118; flange members 136, 138, 140, 142, 144 and 146 for column 120; and a similar number of flange members for column 122 only flange member 148 of which is shown in FIG. 7.

Figure 9:
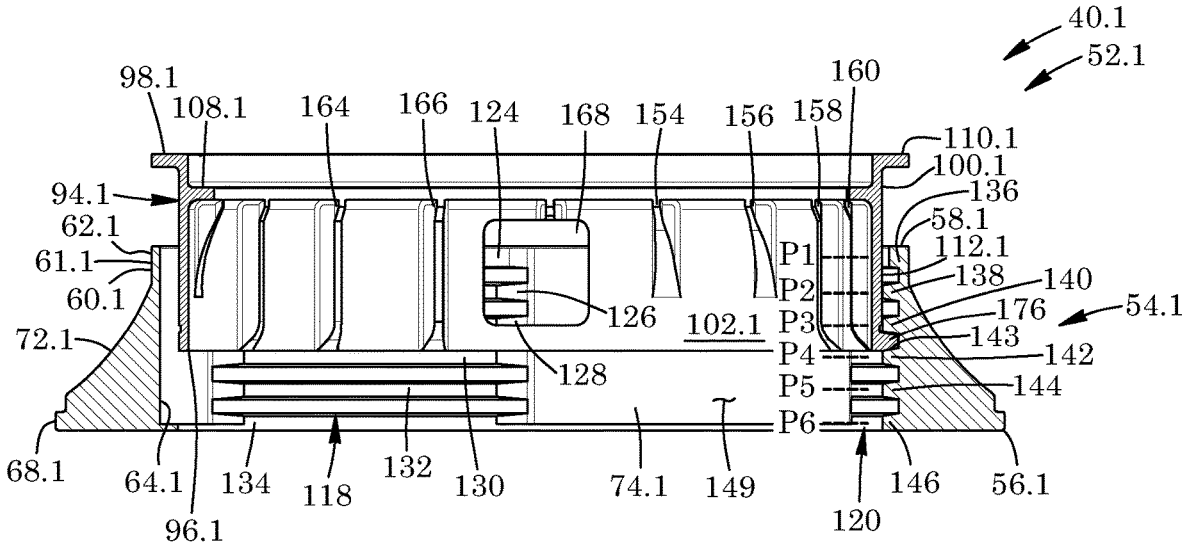
FIG. 9 is a sectional elevation view taken along lines 9-9 of the assembly shown in FIG. 8.

Flange members 124, 136 and 148 align horizontally with each other in a first plane P1 seen in FIG. 9. As seen in FIG. 9: flange members 126 and 138 align horizontally with each other in a second plane P2; flange members 128 and 140 align horizontally with each other in a third plane P3; flange members 130 and 142 align horizontally with each other in a fourth plane P4; flange members 132 and 144 align horizontally with each other in a fifth plane P5; and flange members 134 and 146 align horizontally with each other in a sixth plane P6. Each of the flange members is generally in the shape of an arc-shaped rectangular prism with spaced-apart tapered ends, as seen in FIG. 6 by tapered ends 150 and 152 for flange member 140.

Still referring to FIG. 6, the lower body 54.1 of the manhole assembly 40.1 has a plurality of recessed regions, in this example three evenly spaced-apart recessed regions 149, 151 and 153 that extend from the lower end 56.1 to the upper end 58.1 of the lower body. Recessed region 149 is between the columns 118 and 120 of flange members. Recessed region 151 is between the columns 120 and 122 of flange members. Recessed region 153 is between the columns 122 and 118 of flange members.

The upper body 94.1 of the manhole assembly 40.1 includes a plurality of circumferentially spaced-apart and axially-extending, vertical strengthening ribs, as shown by way of example by ribs 154, 156, 158, 160, 162, 164, and 166. The ribs couple in this example via welding to and extend radially inwards from the interior surface 102.1 of annular wall 100.1 of the upper body. Each of the ribs 154, 156, 158, 160, 162, 164, and 166 is generally an isosceles trapezoid in lateral cross-section in this example. Annular wall 100.1 is continuous and extends from upper end 98.1 of the upper body 94.1 towards lower end 96.1 of the upper body.

Figure 8:
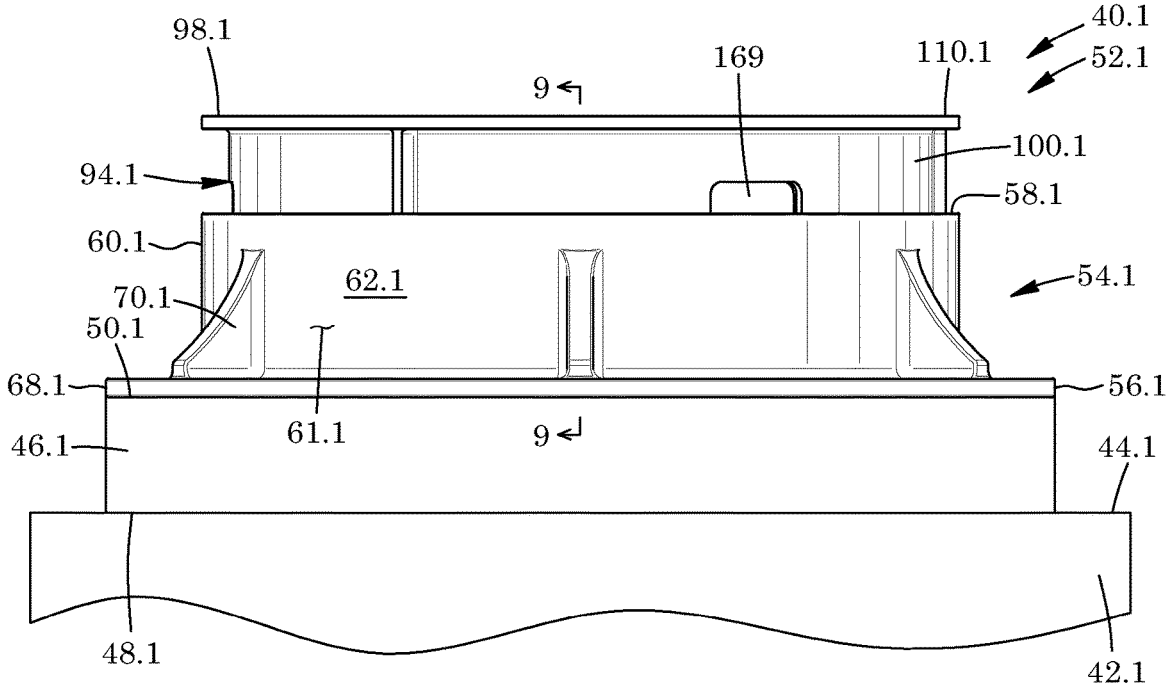
FIG. 8 is a side elevation view of the assembly of FIG. 7, with the upper body partially received by the lower body and being shown in an intermediate height position, and a spacer ring of the assembly further being shown and a manhole barrel of the assembly also being shown in fragment.

A plurality of circumferentially spaced-apart apertures, in this example three apertures, as seen by apertures 168 and 170 in FIG. 6 and aperture 169 in FIG. 8, extend through the annular wall 100.1 of the upper body 94.1. The apertures are rectangular in shape with rounded corners in this example and are shaped to be sufficiently large so as to receive one's hand therethrough.

As seen in FIG. 7, the upper body 94.1 of the manhole assembly 40.1 includes a plurality of circumferentially spaced-apart protuberances, in this example end flange members 172, 174 and 176. The flange members of the upper body are coupled to and extend radially outwards from the exterior surface 112.1 of wall 100.1. Each of the flange members 172, 174 and 176 of the upper body 94.1 is outwardly convex with one side aligned with the exterior 177 of the upper body. The flange members are adjacent to and align with the lower end 96.1 of the upper body in this example. The flange members 172, 174 and 176 of the upper body 94.1 are generally arc-shaped rectangular prisms in shape in this example. Each flange member of the upper body has spaced-apart tapered ends in this example, as seen by tapered ends 178 and 180 for flange member 176 in FIG. 6. The apertures 170 of the wall 100.1 are adjacent to the ends 178 of respective ones of the flange members 176 of the upper body 94.1 in this example.

Referring to FIG. 7, the flange members 172, 174 and 176 of the upper body are shaped to selectively pass through respective ones of the recessed regions 149, 151 and 153 of the lower body 54.1 in an insertion position of the upper body. The height or distance of separation of the upper body 94.1 relative to the flange 68.1 and lower end 56.1 of the lower body 54.1 may be adjusted and selected as desired in the insertion position. Upon the desired height being obtained, the upper body is then axially rotated relative to the lower body from the insertion position to a fixed position in which, as seen in FIG. 9, the flange members 176 of the upper body 94.1 abut with respective one of the flange members of the lower body 54.1 which are aligned in a given plane. This is shown in FIG. 9 by the flange members 176 of the upper body abutting the tops 143 of flange members 142 of the lower body aligned in fourth plane P4. The flange members of the upper body are thus shaped to be received between adjacent pairs of flange members 140 and 142 within a given column 120. In this example and referring to FIG. 6, rotation of the upper body 94.1 relative to the lower body 54.1 by $\alpha$ degrees, in this case 60 degrees in a clockwise direction 181 or counter-clockwise direction 183, enables the manhole assembly 40.1 to move from an insertion position to a fixed position. However, this is not strictly required and there may be other arrangements and columns of flange members and recessed regions in other examples.

Figure 10:
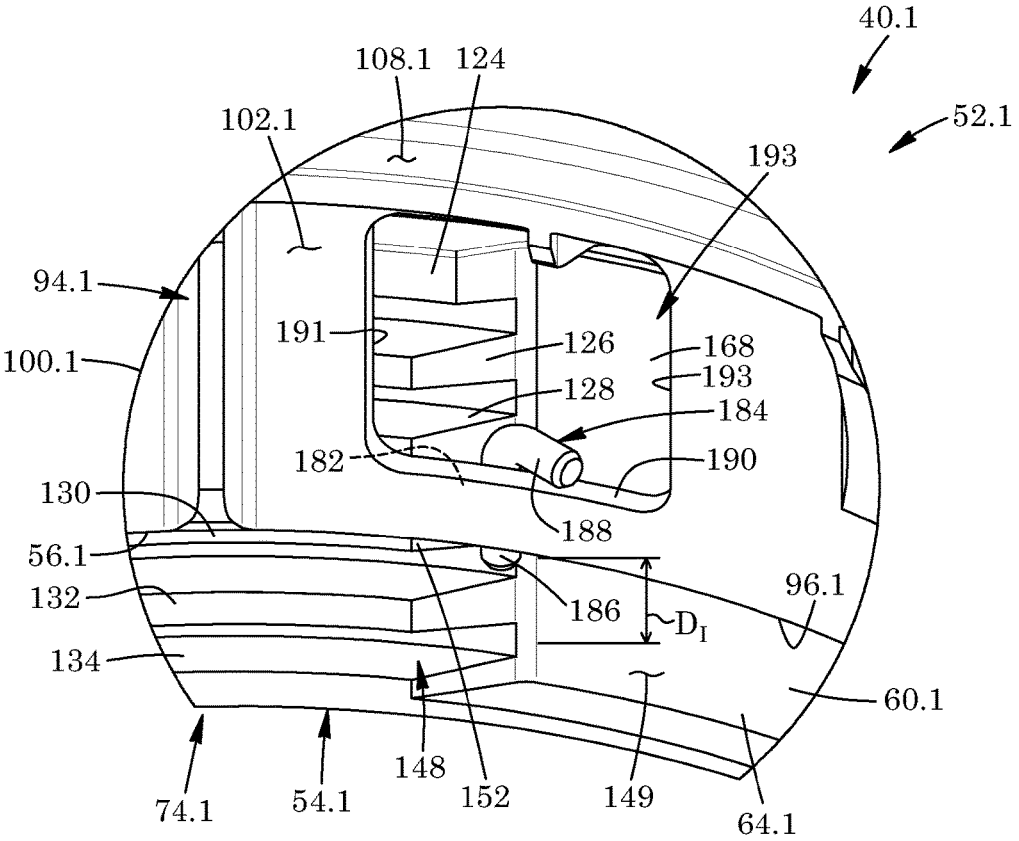
FIG. 10 is an enlarged interior perspective view, shown in fragment, of a locking member of the manhole assembly extending through an aperture of the annular wall of the upper body of manhole assembly, with the locking member engaging with flange members of the lower body of the manhole assembly and inhibiting rotation of the upper body relative to the lower body.
Figure 11:
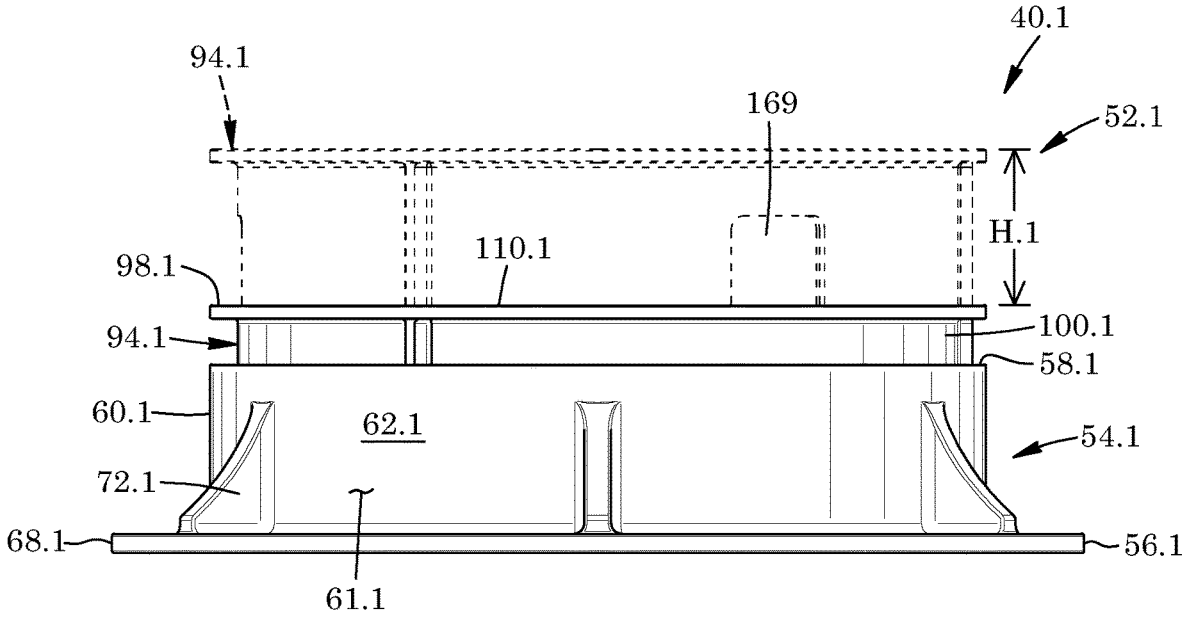
FIG. 11 is a side elevation view of the assembly of FIG. 8, with the upper body shown in solid lines in a retracted position fully disposed within the lower body, and with the upper body shown in stippled lines in an extended position partially disposed within the lower body.

Referring to FIG. 7, each flange member has a groove axially-extending therethrough, as seen by groove 182 extending through flange member 176. The grooves are positioned adjacent to ends 178 of the flange members in this example. As seen in FIG. 10, manhole assembly 40.1 includes a locking member, in this example of an L-shaped locking pin 184. The locking pin is selectively insertable at least in part through one of the apertures 168 of wall 100.1 of the upper body 94.1. The locking pin 184 includes a first portion 186 shaped to be received within groove 182 and which in this example is vertically-extending when in use. The locking pin includes a second portion 188 coupled to and extending perpendicular to the first portion and which in this example is horizontally-extending when in use. The second portion of the locking pin 184 is shaped to extend through aperture 168 and abut a lower peripheral edge 190 of wall 100.1 which is in communication with the aperture in this example. The first portion 186 of the locking pin is abutable with one or more ends 152 of the flange members 130 of the lower body 54.1. Inadvertent or undesired rotation of the upper body 94.1 of the manhole assembly 40.1 relative to the lower body 54.1 of the manhole assembly causes the second portion 188 of the locking pin 184 to abut a respective one of the side peripheral edge portions 191 and 193 of wall 100.1 which are in communication with aperture 168. The side peripheral edge portions 191 and 193 extend upwards from the lower peripheral edge 190 of the wall, and the lower peripheral edge of the wall extends between said side peripheral edge portions. The locking pin 184 so shaped is thus configured to inhibit rotation of the upper body 94.1 relative to the lower body 54.1 upon the upper body 94.1 being rotated into the fixed position seen in FIG. 10.

In this example, the flange members of the lower body 54.1 are arranged such that the upper body 94.1 may be positioned in one of five positions vertically relative to the lower body 94.1, with each of the positions being axially spaced-apart by a set incremental distance $D_I$ seen in FIG. 10. In this embodiment the distance $D_I$ equals to approximately 1.25 inches. In this manner and referring to FIG. 11, the height H.1, or extent to which the upper body 94.1 extends above the lower body 54.1, is selectively adjustable as desired. In this example (H.1) divided by 5 equals to $D_I$. However, neither five positions per se nor the distance of 1.25 inches between positions is strictly required and the distance between flange members of the lower body, as well as the number of axially-spaced-apart flange members of the lower body, may be different in other examples.

FIGS. 12 to 16 show a manhole assembly 40.2 and height adjustment mechanism 52.2 therefor according to a third aspect. Like parts have like numbers and functionings as the manhole assembly 40.1 and height adjustment mechanism 52.1 shown in FIGS. 6 to 11 with decimal extension "0.2" replacing decimal extension "0.1" and being added for parts not previously have decimal extensions. Manhole assembly 40.2 and height adjustment mechanism 52.2 are the same as described for manhole assembly 40.1 and height adjustment mechanism 52.1 shown in FIGS. 6 to 11 with the following exceptions.

Figure 12:
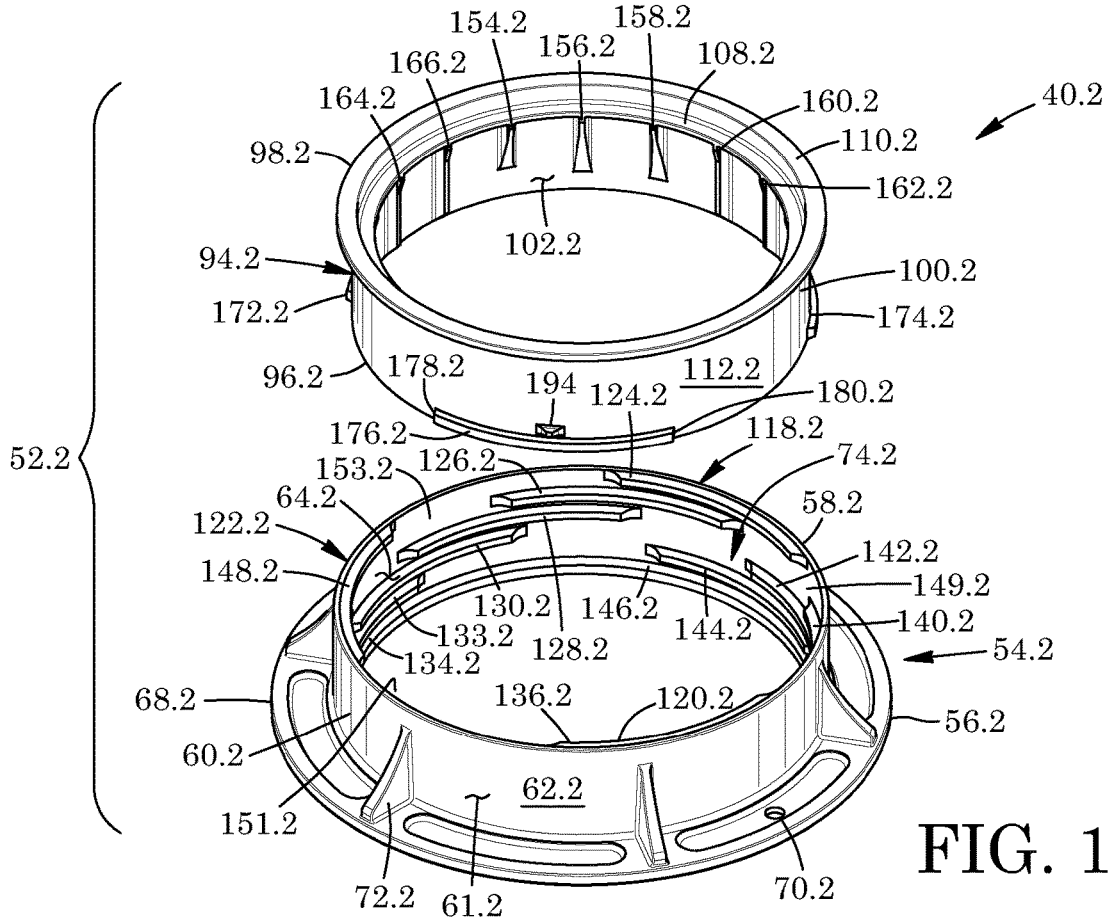
FIG. 12 is a top, front, exploded perspective view of a manhole assembly according to a third aspect, the assembly including an annular lower body comprising a plurality of circumferentially spaced-apart, axially spaced-apart and radially inwardly-extending flange members aligned in a segmented spiral formation, and the assembly including an annular upper body with a plurality of circumferentially spaced-apart, radially outwardly-extending flange members shaped to selectively engage with the flange members of the lower body.
Figure 13:
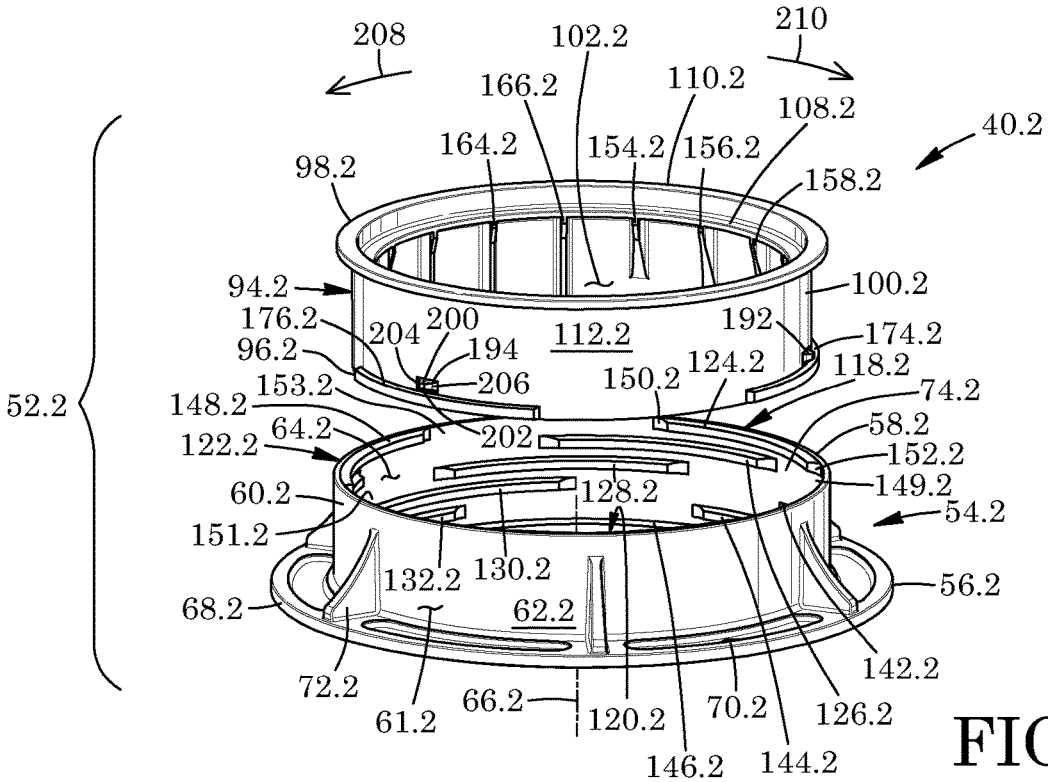
FIG. 13 is a front, exploded perspective view thereof.
Figure 14:
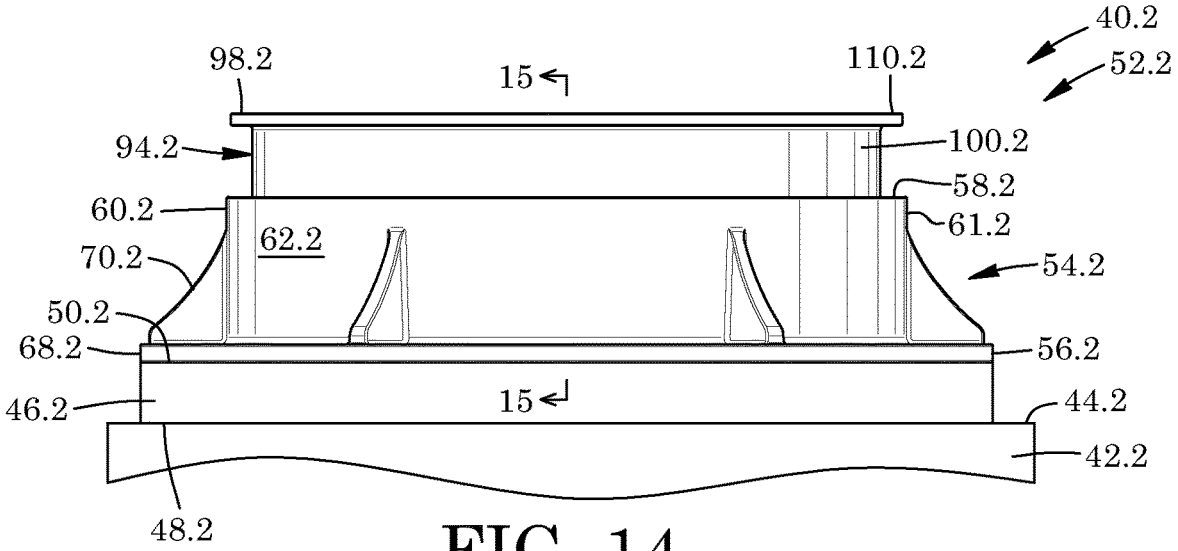
FIG. 14 is a side elevation of the assembly of FIG. 13, with the upper body partially received by the lower body and being shown in an intermediate height position, and a spacer ring of the assembly further shown and a manhole barrel of the assembly also being shown in fragment.

As seen in FIG. 13, upper body 94.2 of the manhole assembly 40.2 includes a plurality of circumferentially spaced-apart stops, in this example three knobs positioned adjacent to respective ones of the flange members of the upper body. This is shown in FIG. 13 by knobs 192 and 194 positioned adjacent to and above flange members 174.2 and 176.2. Each knob is generally a rectangular pyramid in shape in this example with a proximal end 196 coupled to the lower exterior surface 112.2 of wall 100.2, a distal end 198 spaced-apart outwardly from the proximal end, a top 200 which extends and tapers from the proximal end to the distal end, and a bottom 202 which extends and tapers from the proximal end to the distal end. Each knob 194 has a pair of spaced-apart sides 204 and 206 which extend from the top and bottom thereof. The sides of the knob also extend and taper from the proximal end 196 to the distal end 198 of the knob. The top 200, bottom 202 and sides 204 and 206 are generally triangular in this example. Each knob is positioned between the ends of its associated flange member, as seen in FIG. 12 by knob 194 positioned between 178.2 and 180.2 of flange member 176.2.

Referring to FIG. 13, lower body 54.2 of the manhole assembly 40.2 includes a plurality of radially inwardly-extending columns of height-fixing supports, in this example three evenly spaced-apart segmented spiral arrangements 118.2, 120.2 and 122.2 of height-fixing flange members. Adjacent ones of the flange members of the height-fixing support assemblies are arranged in a segmented spiral formation, as seen by segmented spiral formation 118.2 comprising adjacent flange members 124.2, 126.2, 128.2, 130.2, and 132.2. In this example, the flange members extend about central axis 66.2 of the lower body 54.2 of the manhole assembly 40.2 and flange member 124.2 is offset by or angularly spaced-apart by a set angle relative to flange member 126.2 in this case 30 degrees, which in turn is offset by flange member 128.2 by 30 degrees, which in turn is offset by flange member 130.2 by 30 degrees, which in turn is offset by flange member 130.2 by 30 degrees. However, this is not strictly required, and the flange members in a given formation may be offset from each other by a different angular amount in other examples.

Recessed regions 149.2, 151.2 and 153.2 extend from the lower end 56.2 to the upper end 58.2 of the lower body 54.2 and also extend in a segmented spiral formation. As seen in FIG. 13, recessed region 149.2 is between segmented spiral formations 118.2 and 120.2 of flange members. Recessed region 151.2 is between the columns 120.2 and 122.2 of flange members. Recessed region 153.2 is between the columns 122.2 and 118.2 of flange members.

Figure 15:
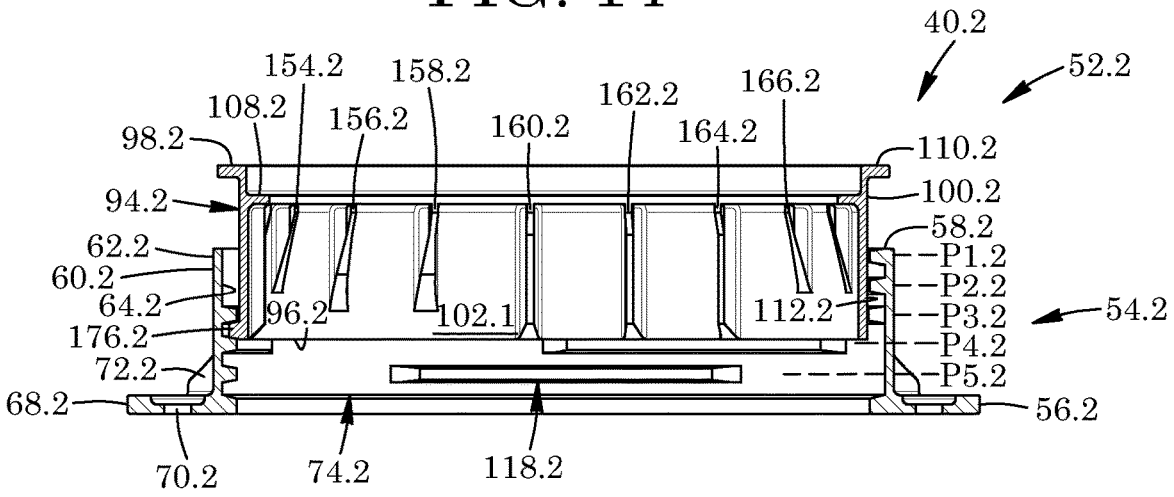
FIG. 15 is a sectional elevation view taken along lines 15-15 of the assembly shown in FIG. 14.

In operation and referring to FIG. 12, lowering upper body 94.2 onto lower body 54.2 causes flange members 172.2, 174.2 and 176.2 of the upper body to abut flange members 148.2, 136.2 and 124.2 aligned in the first plane P1.2 seen in FIG. 15 of the lower body. Referring back to FIG. 13, rotation of the upper body relative to the lower body in a first rotational direction, in this example a counter-clockwise direction as shown by arrow of numeral 208, enables the upper body to incrementally lower into and be received by the lower body until the flange members of the upper body abut the flange members 126.2 of the lower body in the next plane down, in this example the second plane P2.2 seen in FIG. 15.

Knobs 192 and 194 are positioned and shaped such that rotation of the upper body 94.2 in a second rotational direction opposite the first rotational direction, in this example in a clockwise direction as shown by arrow of numeral 210, causes the sides 204 of the knobs 194 to abut the ends 150.2 of the flange members 124.2 of the lower body 54.2 in the plane P1.2 above the plane P2.2 on which the flange members of the upper body are abutting, with said planes being shown in FIG. 15. The knobs thus function to enable rotation of the upper body 94.2 relative to the lower body 54.2 in a first rotational direction and inhibit rotation of the upper body relative to the lower body in a second rotational direction which is opposite the first rotational direction.

Figure 16:
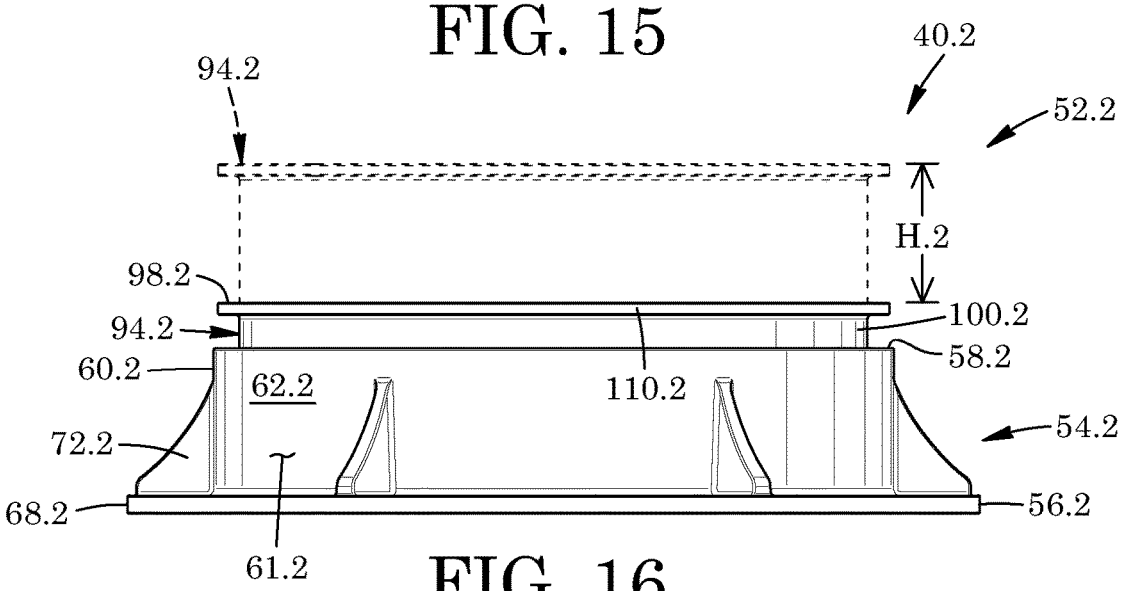
FIG. 16 is a side elevation view of the assembly of FIG. 14, with the upper body shown in solid lines in a retracted position fully disposed within the lower body, and with the upper body shown in stippled lines in an extended position partially disposed within the lower body.

In this manner, the upper body of the manhole assembly 40.2 may continue to be incrementally rotated in a counter-clockwise direction and be thereafter lowered to the flange members of the lower body in the next plane lower down until the desired height H.2 or degree of extension of the upper body relative to the lower body seen in FIG. 16 is achieved. The upper body 94.2 may be removed from the lower body 54.2 by following the above steps in reverse.

FIGS. 17 to 21 show a manhole assembly 40.3 and height adjustment mechanism 52.3 therefor according to a fourth aspect. Like parts have like numbers and functionings as the manhole assembly 40.1 and height adjustment mechanism 52.1 shown in FIGS. 6 to 11 with decimal extension "0.3" replacing decimal extension "0.1" and being added for parts not previously having decimal extensions. Manhole assembly 40.3 and height adjustment mechanism 52.3 are the same as described for manhole assembly 40.1 and height adjustment mechanism 52.1 shown in FIGS. 6 to 11 with the following exceptions.

Figure 18:
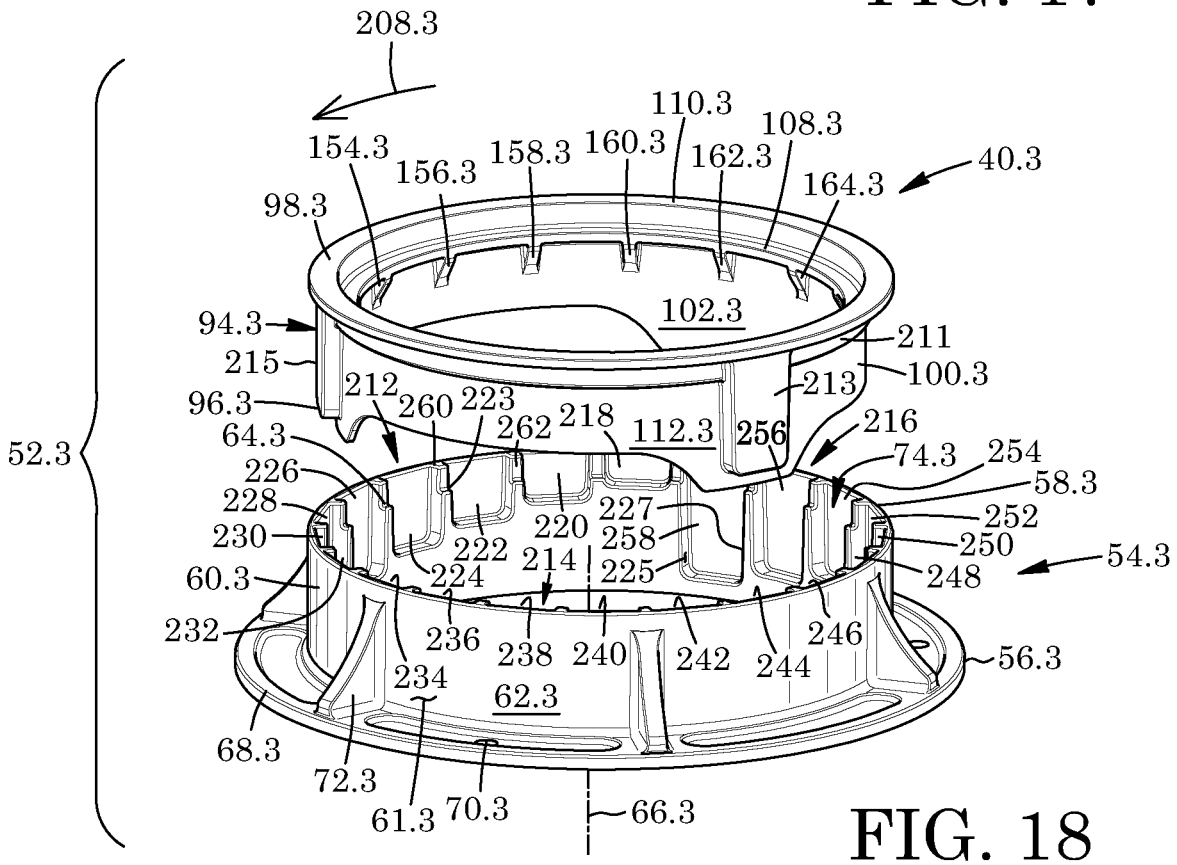
FIG. 18 is a front, exploded perspective view thereof.

As seen in FIG. 18, the upper body 94.3 of the manhole assembly 40.3 includes an annular portion 211 adjacent to the upper end 98.3 thereof. The annular portion of the upper body extends outwards from wall 100.3 and is between the wall and flange 110.3 in this example.

Figure 17:
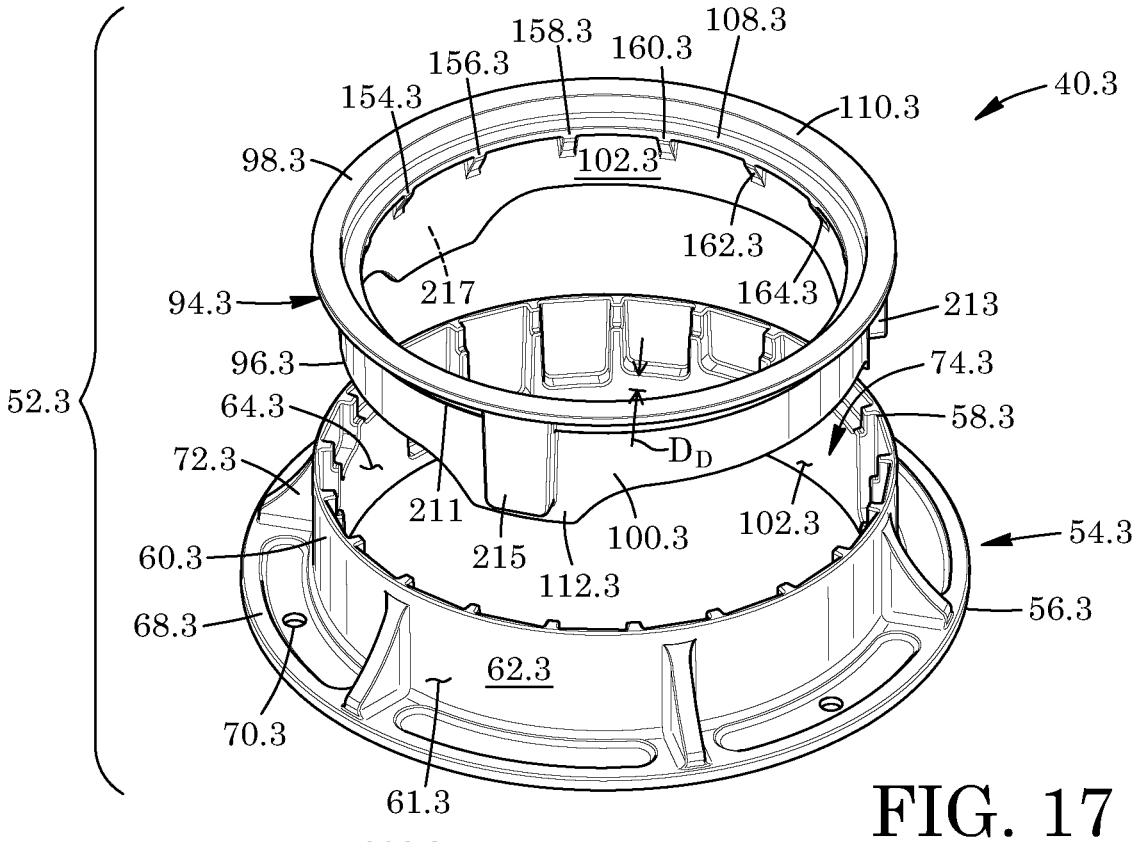
FIG. 17 is a top, front, exploded perspective view of a manhole assembly according to a fourth aspect, the assembly including an annular lower body comprising a plurality of circumferentially spaced-apart receptacles of varying depths, and an annular upper body including a plurality of circumferentially spaced-apart, radially outwardly-extending protrusions shaped to selectively engage with various ones of the receptacles of the lower body.
Figure 19:
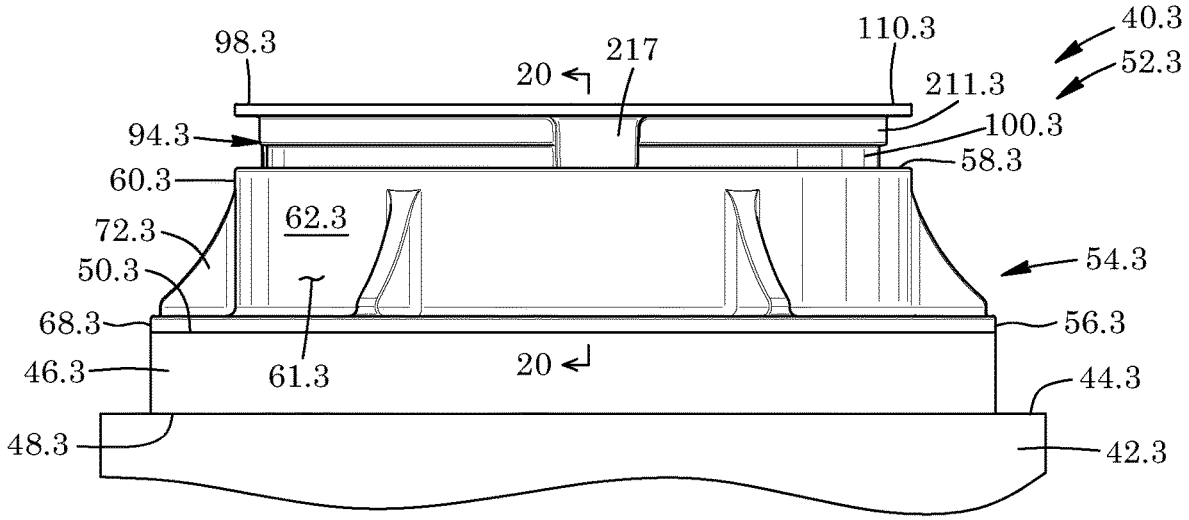
FIG. 19 is a side elevation of the assembly of FIG. 17, with the upper body partially received by the lower body and being shown in an intermediate height position, and a spacer ring of the assembly further being shown and a manhole barrel of the assembly also being shown in fragment.
Figure 20:
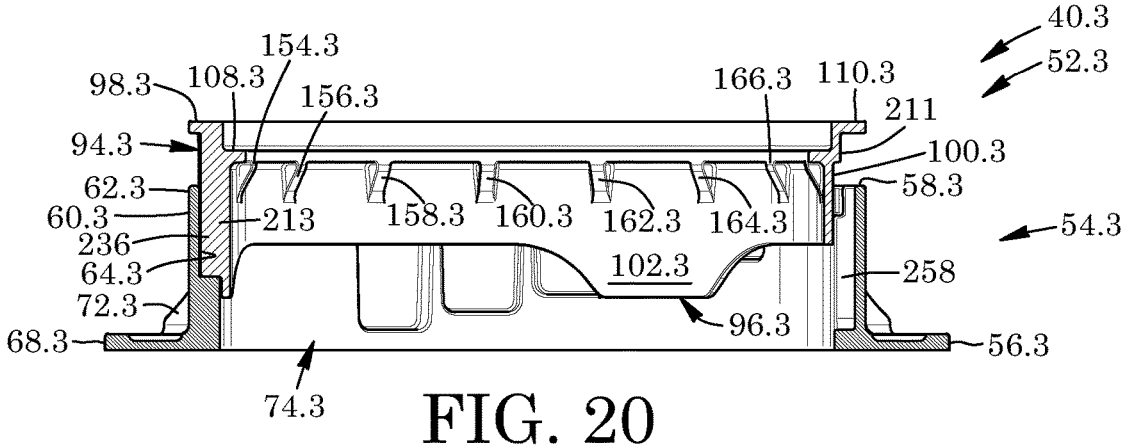
FIG. 20 is a sectional elevation view taken along lines 20-20 of the assembly shown in FIG. 19.
Figure 21:
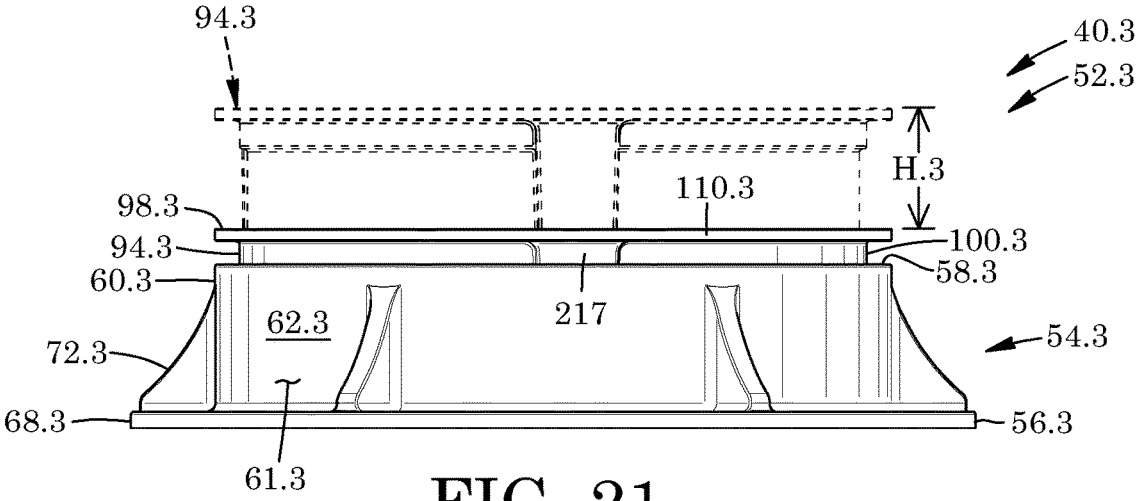
FIG. 21 is a side elevation view of the assembly of FIG. 19, with the upper body shown in solid lines in a retracted position fully disposed within the lower body, and with the upper body shown in stippled lines in an extended position partially disposed within the lower body.

The wall of one of the lower body and the upper body of the manhole assembly 40.3, in this example the wall 100.3 of upper body 94.3 includes a plurality of circumferentially spaced-apart, radially outwardly-extending protrusions: in this case three evenly spaced-apart protrusions as shown by protrusions 213 and 215 in FIG. 17 and as shown by protrusion 217 in FIG. 19. Each of the protrusions couples to and extends radially outwards from wall 100.3 and couples to and extends downwards from flange 110.3 in this example. Each of the protrusions is generally a rectangular prism in shape in this example.

As seen in FIG. 18, another one of the lower body and the upper body of the manhole assembly 40.3, in this example lower body 54.3 includes a plurality of sets of circumferentially spaced-apart, recessed receptacles of varying depths: in this case three sets 212, 214 and 216 of seven receptacles, with each being formed from the wall 60.3 of the lower body in this example. The receptacles are shaped to selectively receive respective ones of the protrusions 213 and 215. Set 212 includes receptacles 218, 220, 222, 224, 226, 228 and 230 of increasing depth in the vertical direction, with respective successive ones of the receptacles extending increasingly downwards from the upper end 58.3 towards the lower end 56.3 of the lower body 54.3. Set 214 includes receptacles 232, 234, 236, 238, 240, 242, and 244 of increasing depth in the vertical direction, with respective successive ones of the receptacles extending increasingly downwards from the upper end towards the lower end of the lower body 54.3. Set 216 includes receptacles 246, 248, 250, 252, 254, 256 and 258 of increasing depth in the vertical direction, with respective successive ones of the receptacles extending increasing downwards from the upper end 58.3 towards the lower end 56.3 of the lower body 54.3.

As seen in FIG. 17, each of the receptacles is generally rectangular in shape in this example and extends radially outwards from interior surface 102.3 of wall 60.3 of the lower body 54.3 towards exterior surface 61.3 of the wall. The wall of the lower body includes a plurality of circumferentially spaced-apart elongate divider portions between adjacent receptacles, with divider portions extending downwards from the upper end 58.3 of the lower body towards the lower end 56.3 of the lower body. This is seen in FIG. 18 by divider portion 260 between receptacles 222 and 224, and divider portion 261 between receptacles 220 and 222. Each of the divider portions is L-shaped in side profile in this example, with each said divider portion 260 including a ledge 223. The ledges of divider portions collectively form an annularly-arranged seat shaped to receive annular portion 211 of upper body 94.3.

Still referring to FIG. 18, the lower body 54.3 of the manhole assembly 40.3 includes a plurality of circumferentially spaced-apart, radially and axially-extending pairs of walls which function to define respective ones of the receptacles in this example. This is shown by walls 225 and 227 between receptacle 258. The walls 225 and 227 extend from the interior surface 64.3 towards the exterior 62.3 of the lower body 54.4.

As seen in FIG. 18, the sets 212, 214 and 216 of receptacles include shallow receptacles 218, 232, and 246, respectively, as best seen by shallow receptacle 218 for set 212. The shallow receptacles extend downwards from the upper end 58.3 of the lower body 54.3 to the same extent and to the least extent relative to the other receptacles. The sets 212, 214 and 216 of receptacles include deep receptacles 230, 244 and 258, as best seen by deep receptacle 258 for set 216. The deep receptacles extend downwards from the upper end 58.3 of the lower body 54.3 to the same extent and to the greatest extent relative to the other receptacles. Deep receptacles 230, 244 and 258 are adjacent to shallow receptacles 232, 246 and 218, respectively, in this example.

Receptacles 220, 234 and 248 extend downwards from the upper end 58.3 of the lower body 54.3 to the same extent and are shaped to be incrementally deeper than shallow receptacles 218, 232 and 246. Receptacles 222, 236 and 250 extend downwards from the upper end of the lower body to the same extent and are shaped to be incrementally deeper than receptacles 220, 234 and 248. Receptacles 224, 238 and 252 extend downwards from the upper end 58.3 of the lower body 54.3 to the same extent and are shaped to be incrementally deeper than receptacles 222, 236 and 250. Receptacles 226, 240 and 254 extend downwards from the upper end of the lower body to the same extent and are shaped to be incrementally deeper than shallow receptacles 224, 238 and 252. Receptacles 228, 242 and 256 extend downwards from the upper end 58.3 of the lower body 54.3 to the same extent and are shaped to be incrementally deeper than receptacles 226, 240 and 254. Deep receptacles 230, 244 and 258 are shaped to be incrementally deeper than receptacles 228, 242 and 256.

In operation and referring to FIG. 18, the upper body 94.3 of the manhole assembly 40.3 may be rotated and lowered onto lower body 54.3 such that protrusions 213 and 215 of the upper body align with and are received by the shallow receptacles 218, 232 and 246 of the lower body. This configuration is the most extended position of height adjustment mechanism 52.3 in which the upper body extends outwards from the lower body to the maximum extent. Raising up and then rotating the upper body 94.3 relative to the lower body 54.3 in a first rotational direction, in this example a counter-clockwise direction as shown by arrow of numeral 208.3, enables the protrusions 213 and 215 of the upper body to be lowered into and be received by the incrementally deeper receptacles 220, 234 and 248 of the lower body. This causes the upper body to be incrementally lowered and incrementally extended upwards relative to the lower body to a lesser degree. In this manner, the upper body 94.3 can be selectively positioned/lowered relative to the lower body 54.3 until a desired height of the manhole assembly 40.3 is achieved. The positioning of the protrusions 213 and 215 of the upper body 94.3 into the deep receptacles 230, 244 and 258 coincides with the height adjustment mechanism 52.3 being in its retracted position.

Height adjustment mechanism 52.3 of manhole assembly 40.3 may result in a strong and secure multi-height positioning solution that still enables the various parts thereof to be cast without cores. The need for machining may further be inhibited by manhole assembly 40.3. Height adjustment mechanism 52.3 may also provide a greater degree of fine adjustment, with the difference in depth DD seen in FIG. 17 between adjacent receptacles within a set being in the order of 0.75 inches in this example. However, this is not strictly required, and this incremental value, as well as the number of receptacles and/or protrusions of the upper body, may vary in other examples.

FIGS. 22 to 28 show a manhole assembly 40.4 and height adjustment mechanism 52.4 therefor according to a fifth aspect. Like parts have like numbers and functionings as the manhole assembly 40.3 and height adjustment mechanism 52.3 shown in FIGS. 17 to 21 with decimal extension "0.4" replacing decimal extension "0.3" and being added for parts not previously having decimal extensions. Manhole assembly 40.4 and height adjustment mechanism 52.4 are the same as described for manhole assembly 40.3 and height adjustment mechanism 52.3 shown in FIGS. 17 to 21 with the following exceptions.

Figure 22:
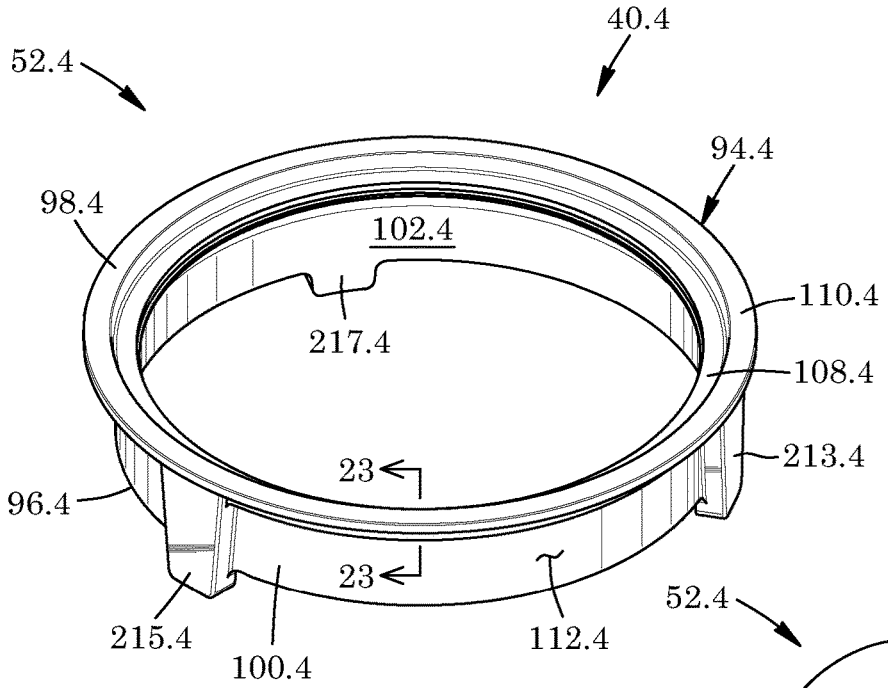
FIG. 22 is top, side perspective view of an annular upper body of a manhole assembly according to a fifth aspect, the annular upper body including a plurality of circumferentially spaced-apart, radially outwardly-extending protrusions.

As seen in FIG. 22, the protrusions 213.4, 215.4 and 217.4 of the upper body 94.4 of the manhole assembly 40.4 are tapered in this embodiment. In this example, each of the protrusions tapers from the upper end 98.4 of the body to the lower end 96.4 of the body. The protrusions are generally trapezoidal prisms in shape in this example.

Figure 23:
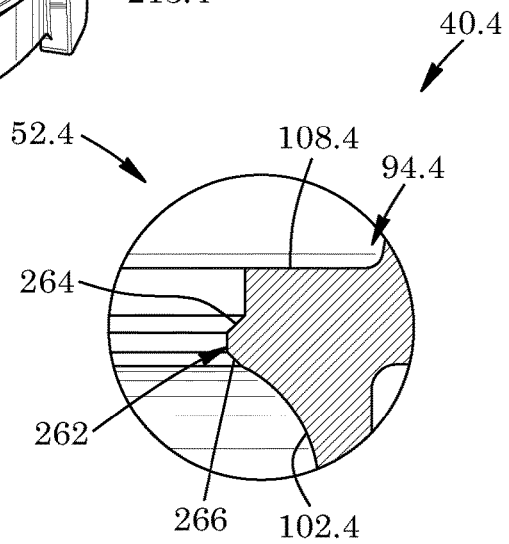
FIG. 23 is a sectional view in fragment taken along lines 23-23 of the annular upper body of the manhole assembly of FIG. 22.
Figure 24:
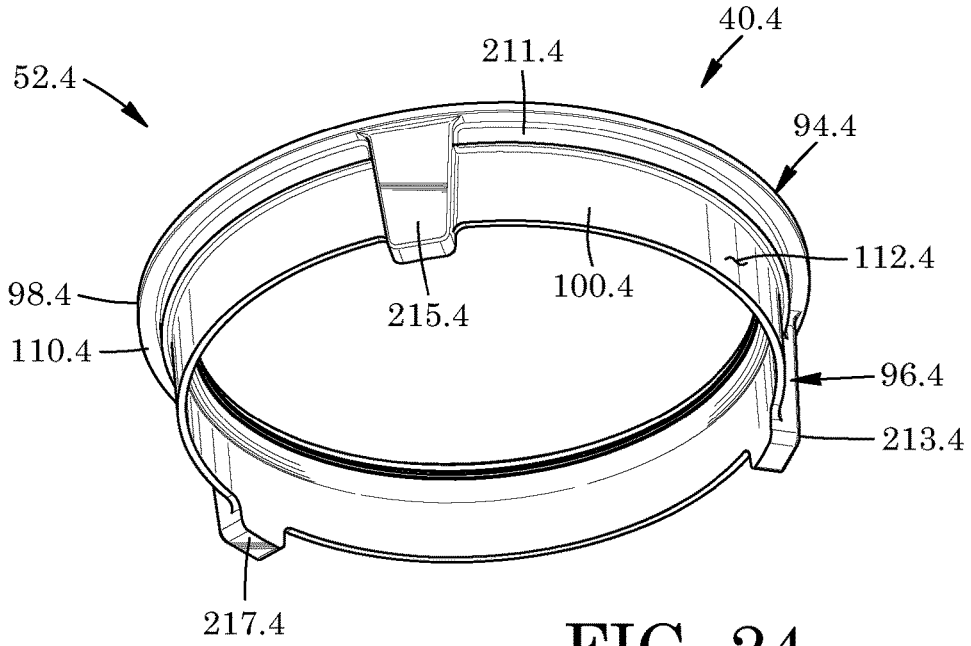
FIG. 24 is a bottom, side perspective view of the annular upper body of the manhole assembly of FIG. 22.

As seen in FIG. 23, the upper body 94.4 of the manhole assembly 40.4 includes an annular protrusion in the form of a seat 262 which is adjacent to, which is below and which extends radially inwards relative to annular lip 108.4 in this embodiment. The seat is trapezoidal in cross-section in this example, with a slopped, inwardly-facing and top-facing upper annular edge portion 264 and a slopped, inwardly-facing and bottom-facing lower annular edge portion 266.

Figure 25:
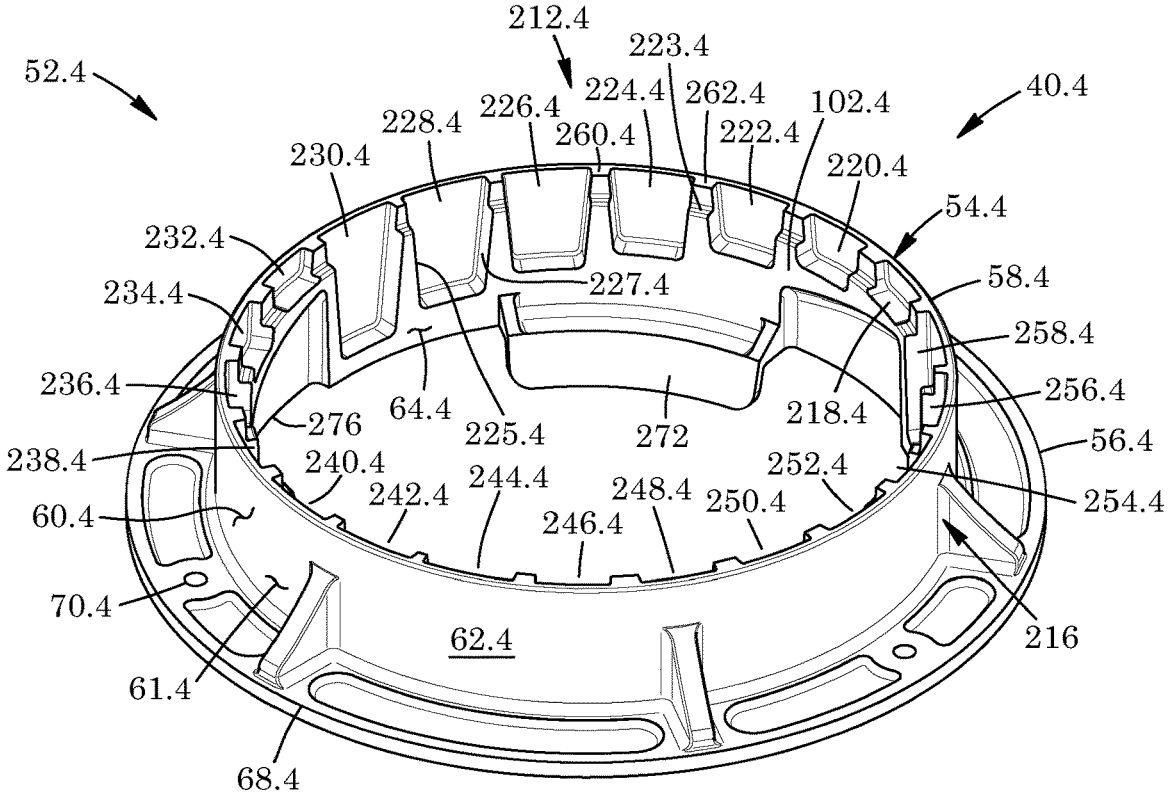
FIG. 25 is a top, side perspective view of an annular lower body of the manhole assembly according to the fifth aspect, the annular lower body comprising a plurality of circumferentially spaced-apart receptacles of varying depths shaped to selectively engage with various ones of the receptacles of the lower body of FIG. 22.

As seen in FIG. 25, the receptacles 218.4, 220.4, 222.4, 224.4, 226.4, 228.4, 230.4, 232.4, 234.4, 236.4, 238.4, 240.4, 242.4, 244.4, 246.4, 248.4, 250.4, 252.4, 254.4, 256.4 and 258.4 of the lower body 52.4 of the manhole assembly 40.4 are tapered, generally trapezoidal in shape, and shaped to fit the protrusions 213.4, 215.4 and 217.4 of the upper body 52.4 seen in FIG. 22. Referring back to FIG. 25, the plurality of circumferentially spaced-apart, radially and axially extending pairs of walls 225.4 and 227.4 for respective ones of the receptacles of the lower body 52.4 are tapered in this embodiment, tapering as the walls extend downwards from the upper end 58.4 towards the lower end 56.4 of the lower body 54.4.

Figure 26:
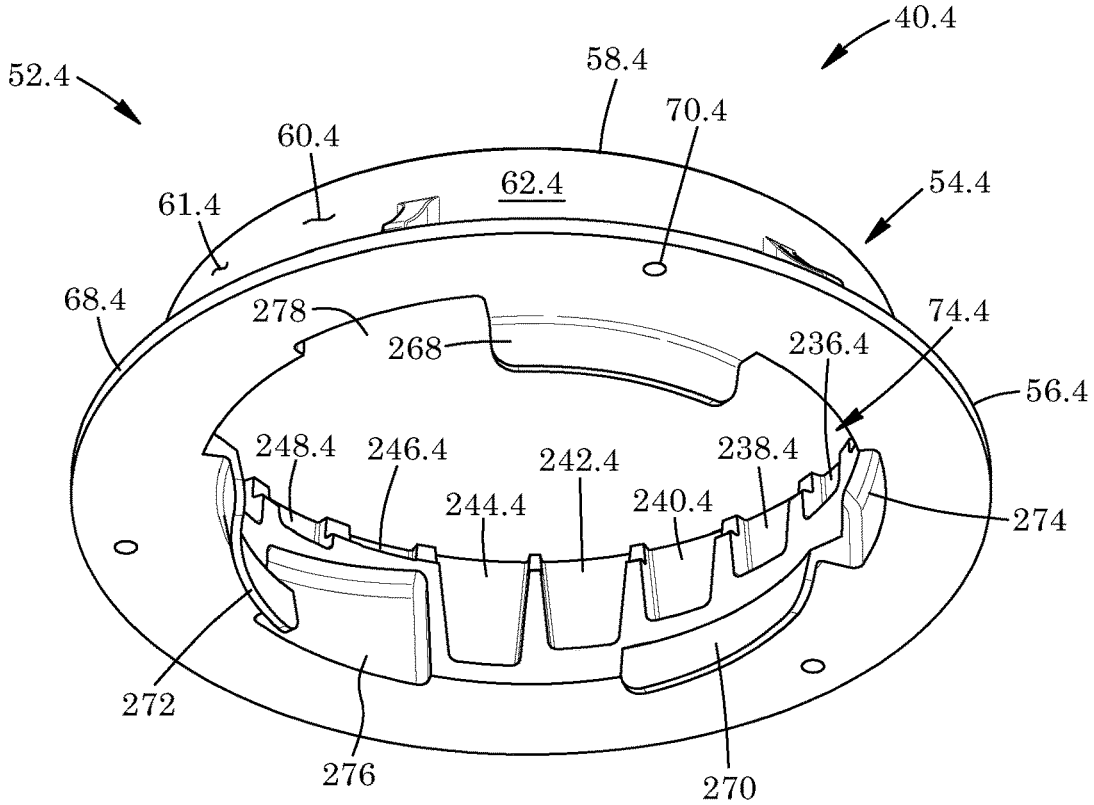
FIG. 26 is a bottom, side perspective view of the lower body of FIG. 25.
Figure 27:
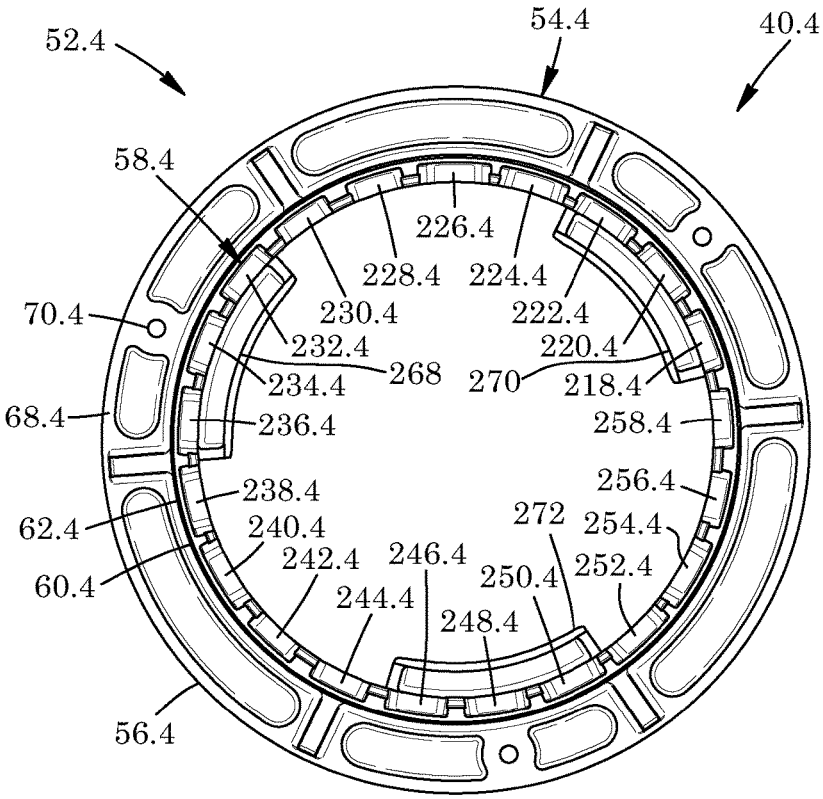
FIG. 27 is a top plan view thereof.
Figure 28:
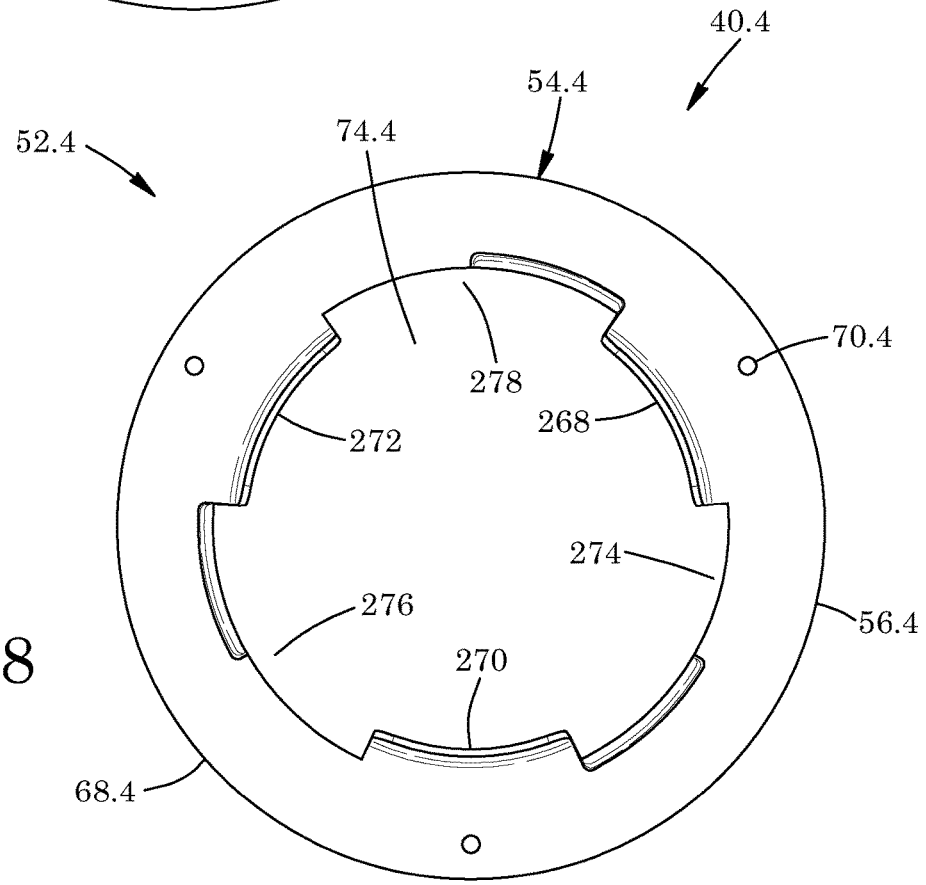
FIG. 28 is a bottom plan view thereof.

Referring to FIG. 26, the lower body of the manhole assembly 40.4 includes a plurality of circumferentially spaced-apart, downwardly-extending positioning members 268, 270 and 272. The members are in communication with bore 74.4. As seen in FIGS. 27 and 28, each of the positioning members 268, 270 and 272 is arcuate-shaped in top and bottom profile in this example. As seen with reference to FIG. 26, each of the positioning members is L-shaped in side cross-section. The positioning members 268, 270 and 272 are shaped to abut with corresponding annular surfaces of a concrete spacer ring, such as ring 46.2 seen in FIG. 14 for manhole assembly 40.2. In this manner, the positioning members 268, 270 and 272 may function to retain positioning of the lower body 52.2 of the manhole assembly 40.4 relative to the spacer ring.

As seen in FIG. 28, the lower body of the manhole assembly includes a plurality of circumferentially spaced-apart, arcuate-shaped recesses 274, 276 and 278 interposed between positioning members 268, 270 and 272, respectively. The recesses align below the shallower receptacles, as seen in FIG. 25 by recess 276 positioned below receptacles 230.4, 232.4 and 236.6 of the lower body 52.4.

ADDITIONAL DESCRIPTION

Examples of manhole assemblies and height adjustment mechanisms thereof have been described. The following clauses are offered as further description.

1. A height adjustment mechanism for a manhole assembly, the height assembly mechanism comprising: an annular lower body having a threaded interior bore; an annular insert threadably engageable with the lower body; and an annular upper body threadably engageable with and extending outwards from the lower body, whereby abutting of the upper body with the insert fixes positioning of the upper body relative to the lower body.
2. The height adjustment mechanism as clause in clause 1, wherein the lower body has a lower end and an upper end spaced-apart from the lower end thereof, and wherein the manhole assembly is moveable from a retracted position to an extended position, the insert being positioned adjacent to the lower end of the lower body when the manhole assembly is in the retracted position, and the insert being positioned near the upper end of the lower body when the manhole assembly is in the extended position.
3. The height adjustment mechanism as clause in any one of clauses 1 to 2, wherein the insert includes at least one radially inwardly-extending protrusion.
4. The height adjustment mechanism as clause in clause 3 wherein the insert has an upper end and an lower end, and wherein the protrusion extends between said upper end and said lower end of the insert.
5. The height adjustment mechanism as clause in any one of clauses 3 and 4, wherein the protrusion is a rectangular prism in shape.
6. The height adjustment mechanism as clause in any one of clauses 1 to 5, wherein the upper body includes at least one radially inwardly-extending protrusion.
7. The height adjustment mechanism as clause in clause 6, wherein the protrusion of the upper body has an outwardly convex facing bottom.
8. The height adjustment mechanism as clause in any one of clauses 1 to 2, wherein both the insert and the upper body include a plurality of circumferentially spaced-apart, radially inwardly-extending protrusions.
9. The height adjustment mechanism as clause in clause 8 wherein each of the insert and the upper body includes four, evenly spaced-apart ones of said protrusions.
10. The height adjustment mechanism as clause in any one of clauses 8 to 9, wherein the protrusions are shaped to receive a tangentially-directed force, said force promoting rotation of the insert and the upper body, respectively.
11. The height adjustment mechanism as clause in any one of clauses 8 to 10, wherein the protrusions are shaped to receive impacts from a hammer, said impacts promoting rotating of the insert and the upper body, respectively.
12. The height adjustment mechanism as clause in any one of clauses 1 to 11, wherein the upper body has a lower end abutting the insert, has an upper end spaced-apart from the lower end thereof, includes a radially outwardly-extending flange adjacent to the upper end thereof, and includes an annular lip positioned between the lower end and the upper end thereof, the annular lip extending radially inwards relative to the flange.
13. A height adjustment mechanism for a manhole assembly, the height assembly mechanism comprising: an annular lower body having a threaded interior bore; an annular upper body threadably engageable with and extending outwards from the lower body, the annular upper body including a plurality of circumferentially spaced-apart, radially inwardly-extending protrusions.
14. The height adjustment mechanism as clause in clause 13, wherein the protrusions are shaped to receive a tangentially-directed force, said force promoting rotation of the upper body relative to the lower body.
15. A height adjustment mechanism for a manhole assembly, the height assembly mechanism comprising: an annular lower body having a bore; and an annular upper body being shaped to selectively fit partially within the bore of the lower body, a first of the lower body and the upper body including a plurality of circumferentially spaced-apart recessed receptacles of varying depths and a second of the lower body and the upper body including at least one protrusion extending outwards therefrom, the protrusion being shaped to at least partially fit within respective ones of said receptacles.

16. The height adjustment mechanism as clause in clause 15 wherein the annular lower body includes an annular wall extending about the bore thereof, wherein the annular upper body includes an annular wall, wherein the wall of the first of the lower body and the upper body includes said plurality of circumferentially spaced-apart recessed receptacles of varying depths and wherein the wall of the second the lower body and the upper body includes said at least one protrusion extending radially outwards therefrom.
17. The height adjustment mechanism as clause in any one of clauses 15 and 16, wherein the protrusion is generally a rectangular prism in shape.
18. The height adjustment mechanism as clause in any one of clauses 15 to 17, wherein the receptacles are generally rectangular prisms in shape.
19. The height adjustment mechanism as clause in any one of clauses 15 and 16, wherein the protrusion is generally a trapezoidal prism in shape.
20. The height adjustment mechanism as clause in any one of clauses 15, 16 and 19, wherein the receptacles are generally trapezoidal prisms in shape.
21. The height adjustment mechanism as clause in any one of clauses 15 and 16, wherein the receptacles are tapered and wherein the at least one protrusion is tapered.
22. The height adjustment mechanism as clause in any one of clauses 15 to 21, wherein the receptacles include a set of three circumferentially spaced-apart shallow receptacles, a set of three circumferentially spaced-apart deep receptacles, and at least one set of three circumferentially spaced-apart receptacles of a depth between the shallow receptacles and the deep receptacles.
23. The height adjustment mechanism as clause in clause 22, wherein the lower body has an upper end and a lower end, wherein each of the receptacles has a bottom, wherein the bottoms of the shallow receptacles are near the upper end of the lower body and wherein the bottoms of the deep receptacles are near the lower end of the lower body.
24. A height adjustment mechanism for a manhole assembly, the height assembly mechanism comprising: an annular lower body having a bore; and an annular upper body being shaped to selectively fit partially within the bore of the lower body, a first of the lower body and the upper body including a plurality of pairs of walls and a second of the lower body and the upper body including at least one protrusion extending outwards therefrom, the protrusion being shaped to at least partially fit within and abut respective ones of said pairs of walls.
25. The height adjustment mechanism as clause in clause 24 wherein the at least one protrusion is tapered and wherein the pairs of walls are tapered.
26. The height adjustment mechanism as clause in any one of clauses 24 to 25, wherein the at least one protrusion is generally a trapezoidal prism in shape.
27. The height adjustment mechanism as clause in any one of clauses 15 to 26, wherein the lower body includes a plurality of circumferentially spaced-apart, arcuate-shaped, downwardly-extending positioning members.
28. A height adjustment mechanism for a manhole assembly, the height assembly mechanism comprising: an annular lower body having a bore, having an axis and including two or more radially inwardly-extending, axially-spaced-apart height-fixing supports; an annular upper body including an annular wall, having an aperture extending through said wall, and including at least one protuberance coupled to and extending radially outwards from the wall, the aperture being adjacent to said protuberance, the upper body being axially rotatable from an insertion position in which the upper body is in part insertable within the bore of the lower body, to a fixed position in which the protuberance is abutable with a respective one of said height-fixing supports; and a locking member selectively insertable via the aperture of the wall, the locking member being configured to inhibit rotation of the upper body relative to the lower body.
29. A height adjustment mechanism for a manhole assembly, the height assembly mechanism comprising: an annular lower body having a bore, having an axis and including two or more radially inwardly-extending, axially-spaced-apart height-fixing supports; an annular upper body including at least one protuberance extending radially outwards therefrom, the protuberance having a groove axially-extending therethrough, the upper body being axially rotatable from an insertion position in which the upper body is insertable in part within the bore of the lower body to a fixed position in which the protuberance is abutable with a respective one of said height-fixing supports; and a locking member insertable within said groove of the protuberance and is abutable with at least one distal end of at least one of said height-fixing supports, the locking member being configured to inhibit rotation of the upper body relative to the lower body.
30. A height adjustment mechanism for a manhole assembly, the height assembly mechanism comprising: an annular lower body having a bore, having an axis and including two or more radially inwardly-extending, axially-spaced-apart height-fixing supports, each of the height-fixing supports having spaced-apart tapered ends; and an annular upper body including at least one radially outwardly-extending protuberance, the protuberance having spaced-apart tapered ends, the upper body being axially rotatable from an insertion position in which the upper body is insertable in part within the bore of the lower body, to a fixed position in which the protuberance is abutable with a respective one of said height-fixing supports.
31. A height adjustment mechanism for a manhole assembly, the height assembly mechanism comprising: an annular lower body having a lower end, an upper end spaced-apart from the lower end, an axis and a bore, the axis and the bore of the annular lower body extending from the lower end to the upper end of the annular lower body, and the annular lower body including a plurality of axially spaced-apart, height-fixing support assemblies; and an annular upper body having a lower end, having an upper end spaced-apart from the lower end of the upper body, and including a plurality of circumferentially spaced-apart, radially outwardly-extending flange members, the flange members being adjacent to the lower end of the upper body, the upper body being axially rotatable from an insertion position in which the upper body is insertable in part within the bore of the lower body to a fixed position in which at least one of the flange members is abutable with a respective one of said height-fixing support assemblies.

32. The height adjustment mechanism as clause in clause 31, wherein each of the height-fixing support assemblies comprises a plurality of circumferentially spaced-apart flange members.

33. The height adjustment mechanism as clause in any one of clauses 31 to 32, wherein adjacent ones of the flange members of the height-fixing support assemblies are aligned in a column.

34. The height adjustment mechanism as clause in any one of clauses 31 to 32, wherein adjacent ones of the flange members of the height-fixing support assemblies are arranged in a segmented spiral formation.

35. A height adjustment mechanism for a manhole assembly, the height assembly mechanism comprising: an annular lower body having a bore, having an axis and including two or more radially-inwardly extending, axially-spaced-apart height-fixing supports; an annular upper body including an annular wall, having an aperture extending through said wall, and including at least one protuberance coupled to and extending radially-outwards from the wall, the aperture being adjacent to said protuberance, the upper body being axially rotatable from an insertion position in which the upper body is in part insertable within the bore of the lower body to a fixed position in which the protuberance is abutable with a respective one of said height-fixing supports; and a locking member selectively insertable via the aperture of the wall, the locking member being configured to inhibit rotation of the upper body relative to the lower body.

36. A height adjustment mechanism for a manhole assembly, the height assembly mechanism comprising: an annular lower body having a bore, having an axis and including two or more radially-inwardly extending, axially-spaced-apart height-fixing supports; an annular upper body including at least one protuberance extending radially-outwards therefrom, the protuberance having a groove axially-extending therethrough, the upper body being axially rotatable from an insertion position in which the upper body is insertable in part within the bore of the lower body to a fixed position in which the protuberance is abutable with a respective one of said height-fixing supports; and a locking member insertable within said groove of the protuberance and is abutable with at least one distal end of at least one of said height-fixing supports, the locking member being configured to inhibit rotation of the upper body relative to the lower body.

37. A height adjustment mechanism for a manhole assembly, the height assembly mechanism comprising: an annular lower body having a bore, having an axis and including two or more radially-inwardly extending, axially-spaced-apart height-fixing supports, each of the height-fixing supports having spaced-apart tapered ends; and an annular upper body including at least one radially-outwardly extending protuberance, the protuberance having spaced-apart tapered ends, the upper body being axially rotatable from an insertion position in which the upper body is insertable in part within the bore of the lower body to a fixed position in which the protuberance is abutable with a respective one of said height-fixing supports.

38. A height adjustment mechanism for a manhole assembly, the height assembly mechanism comprising: an annular lower body having a lower end, an upper end spaced-apart from the lower end, an axis and a bore, the axis and the bore of the annular lower body extending from the lower end to the upper end of the annular lower body, and the annular lower body including a plurality of axially spaced-apart, height-fixing support assemblies; and an annular upper body having a lower end, having an upper end spaced-apart from the lower end of the upper body, and including a plurality of circumferentially spaced-apart, radially-outwardly extending flange members, the flange members being adjacent to the lower end of the upper body, the upper body being axially rotatable from an insertion position in which the upper body is insertable in part within the bore of the lower body to a fixed position in which at least one of the flange members is abutable with a respective one of said height-fixing support assemblies.

39. The height adjustment mechanism as set out in clause 38, wherein each of the height-fixing support assemblies comprises a plurality of circumferentially spaced-apart flange members.

40. The height adjustment mechanism as set out in any one of clauses 38 and 39, wherein adjacent ones of the flange members of the height-fixing support assemblies are aligned in a column.

41. The height adjustment mechanism as set out in any one of clauses 38 and 39 wherein adjacent ones of the flange members of the height-fixing support assemblies are arranged in a segmented spiral formation.

42. A manhole assembly comprising the height adjustment mechanism as clause in any one of clauses 1 to 41.

It will be appreciated that many variations are possible within the scope of the invention described herein. It will be understood by someone skilled in the art that many of the details provided above are by way of example only and are not intended to limit the scope of the invention which is to be determined with reference to at least the following claims.

What is claimed is:

1. A height adjustment mechanism for a manhole assembly, the height assembly mechanism comprising:

an annular lower body having a bore and including one or more downwardly-extending positioning members; and an annular upper body shaped to at least partially fit within the bore of the lower body, wherein a first of the lower body and the upper body includes a plurality of circumferentially spaced-apart recessed receptacles or pairs of walls of varying depths, wherein a second of the lower body and the upper body includes at least one protrusion extending outwards therefrom, and wherein the at least one protrusion is shaped to at least partially fit within respective ones of said receptacles or between respective pairs of said pairs of walls.

2. The height adjustment mechanism as claimed in claim 1, wherein the lower body includes an annular wall extending about the bore thereof, wherein the upper body includes an annular wall, wherein the annular wall of the first of the lower body and the upper body includes said plurality of circumferentially spaced-apart recessed receptacles of varying depths and wherein the annular wall of the second of the lower body and the upper body includes said at least one protrusion extending radially outwards therefrom.

3. The height adjustment mechanism according to claim 1, wherein the one or more said positioning members are one or more of: arcuate-shaped and circumferentially spaced-apart.

4. The height adjustment mechanism as claimed in claim 1, wherein the receptacles are tapered and the at least one protrusion is tapered.

5. A manhole assembly comprising the height adjustment mechanism as claimed in claim 1.

6. The height adjustment mechanism as claimed in claim 1, wherein the at least one protrusion is generally a trapezoidal prism in shape.

7. A height adjustment mechanism for a manhole assembly, the height adjustment mechanism comprising:

an annular lower body having a bore and including a plurality of circumferentially spaced-apart recessed receptacles of varying depth or pairs of walls of varying depth; and an annular upper body being shaped to selectively fit partially within the bore of the lower body, the upper body including an annular wall with a bottom and a top, and the upper body including at least one outwardly-extending protrusion coupled to and outwardly extending from the annular wall, the at least one protrusion being shaped to at least partially fit within respective ones of said receptacles or between respective pairs of said pairs of walls, and the at least one protrusion extending from adjacent the bottom of the annular wall towards the top of the annular wall.

8. The height adjustment mechanism as claimed in claim 7, wherein the pairs of walls are formed by a plurality of elongate divider portions, with each said divider portion being L-shaped in side profile in a radial direction so as to function as a ledge.

9. The height adjustment mechanism as claimed in claim 7, wherein the at least one protrusion is generally a rectangular prism in shape.

10. The height adjustment mechanism as claimed in claim 7, wherein the receptacles are rectangular in shape.

11. The height adjustment mechanism as claimed in claim 7, wherein the at least one protrusion is generally a trapezoidal prism in shape.

12. The height adjustment mechanism as claimed in claim 7, wherein the receptacles are generally trapezoidal in shape.

13. The height adjustment mechanism as claimed in claim 7, wherein rotation of the upper body relative to the lower body causes the at least one protrusion to fit within different respective ones of said receptacles, with the extent to which the upper body extends upwards from the lower body being adjustable thereby.

14. The height adjustment mechanism as claimed in claim 7, wherein the receptacles include at least one shallow said receptacle, at least one deep said receptacle, and at least one said receptacle of a depth between the at least one shallow said receptacle and the at least one deep said receptacle.

15. The height adjustment mechanism as claimed in claim 14, wherein the lower body has an upper end and a lower end, wherein each of the receptacles has a bottom, wherein the bottom of the at least one shallow said receptacle is near the upper end of the lower body, and wherein the bottom of the at least one deep said receptacle is near the lower end of the lower body.

16. A manhole assembly comprising the height adjustment mechanism as claimed in claim 7.

17. A height adjustment mechanism for a manhole assembly, the height adjustment mechanism comprising:

an annular lower body having a bore; and an annular upper body being shaped to selectively fit partially within the bore of the lower body, a first of the lower body and the upper body including at least one of a plurality of circumferentially spaced-apart recessed receptacles of varying depth or pairs of walls of varying depths, and a second of the lower body and the upper body including an annular wall and at least one outwardly-extending protrusion coupled to and extending radially and axially outwards from the annular wall, the at least one protrusion being shaped to at least partially fit within respective ones of said receptacles or between respective pairs of said pairs of walls.

18. The height adjustment mechanism as claimed in claim 17, wherein the at least one protrusion is tapered and wherein the pairs of walls are tapered.

19. The height adjustment mechanism as claimed in claim 17, wherein rotation of the upper body relative to the lower body causes the at least one protrusion to fit within different respective ones of said pairs of walls, with the extent to which the upper body extends upwards from the lower body being adjustable thereby.

20. A manhole assembly comprising the height adjustment mechanism as claimed in claim 17.

* * * * *